US010078286B2

(12) United States Patent
Takeno et al.

(10) Patent No.: US 10,078,286 B2
(45) Date of Patent: Sep. 18, 2018

(54) CHARGING MEMBER, PROCESS CARTRIDGE AND ELECTROPHOTOGRAPHIC APPARATUS

(71) Applicant: CANON KABUSHIKI KAISHA, Tokyo (JP)

(72) Inventors: Kineo Takeno, Suntou-gun (JP); Hiroshi Mayuzumi, Yokohama (JP); Masataka Kodama, Mishima (JP); Noriyuki Doi, Numazu (JP); Kenichi Yamauchi, Mishima (JP); Noriko Suzumura, Mishima (JP); Hiroki Masu, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 15 days.

(21) Appl. No.: 15/091,554

(22) Filed: Apr. 5, 2016

(65) Prior Publication Data

US 2016/0299450 A1 Oct. 13, 2016

(30) Foreign Application Priority Data

Apr. 10, 2015 (JP) ..... 2015-081145

(51) Int. Cl.
*H01B 1/04* (2006.01)
*G03G 15/02* (2006.01)

(52) U.S. Cl.
CPC ..... *G03G 15/0233* (2013.01)

(58) Field of Classification Search
CPC ..... G03G 15/0233; H01B 1/04
See application file for complete search history.

(56) References Cited

U.S. PATENT DOCUMENTS

| | | | | |
|---|---|---|---|---|
| 7,947,339 | B2 | 5/2011 | Yamauchi et al. | |
| 8,227,087 | B2 | 7/2012 | Mayuzumi et al. | |
| 8,277,947 | B2 | 10/2012 | Mayuzumi et al. | |
| 8,383,234 | B2 | 2/2013 | Mayuzumi et al. | |
| 8,503,911 | B2 | 8/2013 | Suzumura et al. | |
| 8,526,857 | B2 | 9/2013 | Tomomizu et al. | |
| 8,548,359 | B2 | 10/2013 | Taniguchi et al. | |
| 8,971,766 | B2 | 3/2015 | Taniguchi et al. | |
| 9,268,243 | B2 | 2/2016 | Aoyama et al. | |
| 2006/0226572 | A1 | 10/2006 | Tanaka et al. | |
| 2013/0004206 | A1 | 1/2013 | Kuroda et al. | |
| 2013/0034369 | A1 | 2/2013 | Masu et al. | |
| 2013/0064571 | A1 | 3/2013 | Kodama et al. | |
| 2014/0004258 | A1* | 1/2014 | Suzumura ..... | G03G 15/02 427/126.1 |
| 2014/0072343 | A1 | 3/2014 | Masu et al. | |

(Continued)

FOREIGN PATENT DOCUMENTS

JP 4-77766 A 3/1992

OTHER PUBLICATIONS

STIC Search Report dated Sep. 23, 2017.*

(Continued)

*Primary Examiner* — Eisa B Elhilo
(74) *Attorney, Agent, or Firm* — Fitzpatrick Cella Harper and Scinto

(57) ABSTRACT

A charging member which has high charging ability and prevents generation of abnormal discharge is provided. The charging member includes a support and a surface layer. The surface layer contains a polymetalloxane having a specific structure.

19 Claims, 5 Drawing Sheets

(56) References Cited

U.S. PATENT DOCUMENTS

| | | | |
|---|---|---|---|
| 2014/0080691 | A1 | 3/2014 | Kurachi et al. |
| 2015/0331348 | A1 | 11/2015 | Doi et al. |

OTHER PUBLICATIONS

STIC Search Report dated Jul. 10, 2017.*
Masu, et al., U.S. Appl. No. 14/956,862, filed Dec. 2, 2015.
Yamauchi, et al., U.S. Appl. No. 14/945,297, filed Nov. 18, 2015.
Nishioka, et al., U.S. Appl. No. 14/943,774, filed Nov. 17, 2015.
Masu, et al., U.S. Appl. No. 14/946,768, filed Nov. 19, 2015.
Yamauchi, et al., U.S. Appl. No. 14/945,314, filed Nov. 18, 2015.

* cited by examiner

CHARGING MEMBER, PROCESS CARTRIDGE AND ELECTROPHOTOGRAPHIC APPARATUS

BACKGROUND OF THE INVENTION

Field of the Invention

The present invention relates to a charging member, and a process cartridge and an electrophotographic image forming apparatus including the charging member (hereinafter, referred as "electrophotographic apparatus").

Description of the Related Art

One of methods of charging the surfaces of electrophotographic photosensitive members (hereinafter referred as "photosensitive members") is a contact charging method. In the contact charging method, voltage is applied to a charging member disposed on the photosensitive member to be in contact therewith and very small discharge is generated near the contact portion between the charging member and the photosensitive member to charge the surface of the photosensitive member.

A typical configuration of the charging member used in the contact charging method includes an electro-conductive elastic layer to obtain a desired electric resistance. Japanese Patent Application Laid-Open No. H04-77766 proposes disposition of a resin layer containing a hydroxystyrene resin on an electro-conductive elastic layer to reduce a fluctuation in electric resistance of the electro-conductive elastic layer according to the environment for use.

SUMMARY OF THE INVENTION

The present invention is directed to providing a charging member having high charging ability.

The present invention is also directed to providing a process cartridge and an electrophotographic apparatus suitable for formation of electrophotographic images with high quality.

One aspect of the present invention, there is provided a charging member including a support and a surface layer, wherein the surface layer contains a polymetalloxane having a structure represented by Structural Formula (a1); and M1 in the polymetalloxane and a carbon atom in a structural unit represented by Structural Formula (a2) are bonded with a linking group represented by Structural Formula (a3):

Structural Formula (a1)

$$M1O_{(k-(s+1))/2}(L1)_s$$

Structural Formula (a2)

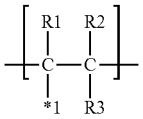

Structural Formula (a3)

$$*2\text{-}O\text{—}Z\text{-}*1$$

where in Formula (a1),

M1 represents a metal atom selected from the group consisting of Ti, Zr, Hf, V, Nb, Ta, W, Al, Ga, In and Ge; s represents an integer of 0 or more and (k−2) or less;

in the case that M1 is Al, Ga or In, then k=3;

in the case that M1 is Ti, Zr, Hf or Ge, then k=4;

in the case that M1 is Nb, Ta or W, then k=5;

in the case that M1 is V, then k=3 or 5; and

L1 represents a ligand having a structure represented by Formula (b) or a ligand having a structure represented by Formula (c):

(b)

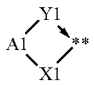

where in Formula (b),

X1 represents a structure represented by one of Formulae (1) to (4);

Y1 represents a group having a site of coordination with M1;

A1 represents a bond or an atomic group needed to form a 4- to 8-membered ring with M1, X1 and Y1; and a symbol "**" represents a site of bonding to or coordination with M1:

(1)

$$*\text{—}O\text{—}$$

(2)

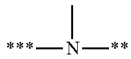

(3)

$$*\text{—}S\text{—}$$

(4)

$$*\text{—}CO\text{—}O\text{—}$$

where in Formulae (1) to (4), a symbol "" represents a site of bonding to M1; and a symbol "*" represents a site of bonding to A1;

(c)

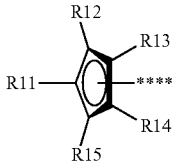

where in Formula (c), R11 to R15 each independently represent a hydrogen atom, an alkyl group having 1 to 4 carbon atoms, or a trimethylsilyl group; and a symbol "****" represents a site of coordination with M1;

where in Formula (a2), R1 to R3 each independently represent a hydrogen atom or an alkyl group having 1 to 3 carbon atoms; and a symbol "*1" represents a site of bonding to Z in Formula (a3); and where in Formula (a3), Z represents a substituted or unsubstituted phenylene group, provided that the substituent in the substituted phenylene group is a halogen atom or an alkyl group having 1 to 3 carbon atoms;

a symbol "*1" represents a position of bonding to the symbol "*1" in Formula (a2); and a symbol "*2" represents a position of bonding to M1 in Formula (a1).

Another aspect of the present invention, there is provided a charging member including a support and a surface layer, wherein the surface layer contains a reaction product of a polymer having a structural unit containing a phenolic hydroxyl group, and a metal alkoxide having a structure represented by Formula (d), and the reaction product is in an amorphous state:

$$M2(OR2)_{q-p}(L2)_p \quad (d)$$

Where in Formula (d),

M2 represents a metal atom selected from the group consisting of Ti, Zr, Hf, V, Nb, Ta, W, Al, Ga, In and Ge;

p represents an integer of 0 or more, with the proviso that (q−p) is 2 or more;

in the case that M2 is Al, Ga or In, then q=3;

in the case that M2 is Ti, Zr, Hf or Ge, then q=4;

in the case that M2 is Nb, Ta or W, then q=5;

in the case that M2 is V, then q=3 or 5; R2 represents a hydrocarbon group having 1 to 10 carbon atoms; and L2 represents a ligand having a structure represented by Formula (e) or a ligand having a structure represented by Formula (f):

(e)

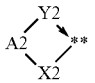

Where in Formula (e),

X2 represents a structure represented by one of Formulae (10) to (13);

Y2 represents a group having a site of coordination with M2;

A2 represents a bond or an atomic group needed to form a 4- to 8-membered ring with M2, X2 and Y2; and a symbol "**" represents a site of bonding to or coordination with M2:

(10)

(11)

(12)

(13)

where in Formulae (10) to (13), a symbol "" represents a site of bonding to M2; and a symbol "*" represents a site of bonding to A2;

(f)

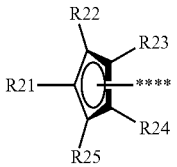

where in Formula (f), R21 to R25 each independently represent a hydrogen atom, an alkyl group having 1 to 4 carbon atoms, or a trimethylsilyl group; and a symbol "****" represents a site of coordination with M2.

Further aspect of the present invention, there is provided a process cartridge detachably attachable to a main body of an electrophotographic apparatus, the process cartridge integrally supporting an electrophotographic photosensitive member and a charging member for charging the surface of the electrophotographic photosensitive member, wherein the charging member is the above-described charging member.

Still further another aspect of the present invention, there is provided an electrophotographic apparatus including an electrophotographic photosensitive member and a charging member for charging the surface of the electrophotographic photosensitive member, wherein the charging member is the above-described charging member.

Further features of the present invention will become apparent from the following description of exemplary embodiments with reference to the attached drawings.

DESCRIPTION OF THE EMBODIMENTS

Figure 1:
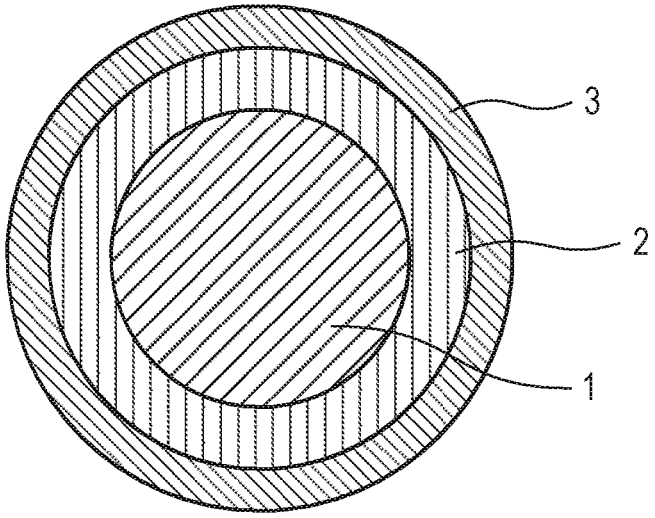
FIG. 1 is a cross-sectional view of an example of the charging member according to the present invention.

Preferred embodiments of the present invention will now be described in detail in accordance with the accompanying drawings.

A time for charging a photosensitive members has been relatively shortened with an increase in the speed of the electrophotographic image forming process in recent years, which causes disadvantages for stable and ensuring charging of the photosensitive members.

According to the investigation of the present inventors, it has found that if the electro-conductive roll described in Japanese Patent Application Laid-Open No. H04-77766 is used as a charging member, strong local discharge (abnormal discharge) may occur particularly under low temperature and low humidity because of the increased process speed. The present inventors have also found that unevenness of images in order of several tens of micrometers to several millimeters may occur due to the abnormal discharge.

The present inventors have repeatedly investigated to achieve a charging member having high charging ability to prevent generation of abnormal discharge. As a result, the present inventors have found that a charging member including a surface layer containing a polymetalloxane having a specific structure can significantly effectively prevent generation of abnormal discharge.

The charging member according to one embodiment of the present invention includes a support and a surface layer disposed on the support.

The surface layer contains a polymetalloxane having a structure represented by Structural Formula (a1). M1 in the polymetalloxane is bonded to a carbon atom in a structural unit represented by Structural Formula (a2) through a linking group represented by Structural Formula (a3):

Structural Formula (a1)

$$M1O_{(k-(s+1))/2}(L1)_s$$

Structural Formula (a2)

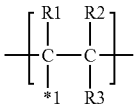

Structural Formula (a3)

$$*2—O—Z—*1$$

where in Formula (a1),

M1 represents a metal atom selected from the group consisting of Ti, Zr, Hf, V, Nb, Ta, W, Al, Ga, In and Ge; s represents an integer of 0 or more and (k−2) or less;

in the case that M1 is Al, Ga or In, then k=3;

in the case that M1 is Ti, Zr, Hf or Ge, then k=4;

in the case that M1 is Nb, Ta or W, then k=5;

in the case that M1 is V, then k=3 or 5; and

L1 represents a ligand having a structure represented by Formula (b) or a ligand having a structure represented by Formula (c):

(b)

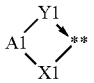

where in Formula (b), X1 represents a structure represented by one of Formulae (1) to (4); Y1 represents a group having a site of coordination with M1; A1 represents a bond or an atomic group needed to form a 4- to 8-membered ring with M1, X1 and Y1; and a symbol "**" represents a site of bonding to or coordination with M1:

(1)

$$*—O—$$

(2)

$$*—\overset{|}{N}—$$

(3)

$$*—S—$$

(4)

$$*—CO—O—$$

where in Formulae (1) to (4), a symbol "" represents a site of bonding to M1; and a symbol "*" represents a site of bonding to A1;

(c)

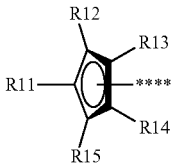

where in Formula (c), R11 to R15 each independently represent a hydrogen atom, an alkyl group having 1 to 4 carbon atoms, or a trimethylsilyl group; and a symbol "****" represents a site of coordination with M1;

where in Formula (a2), R1 to R3 each independently represent a hydrogen atom or an alkyl group having 1 to 3 carbon atoms; and a symbol "*1" represents a site of bonding to Z in Formula (a3); and where in Formula (a3), Z represents a substituted or unsubstituted phenylene group, provided that the substituent in the substituted phenylene group is a halogen atom or an alkyl group having 1 to 3 carbon atoms;

a symbol "*1" represents a position of bonding to the symbol "*1" in Formula (a2); and a symbol "*2" represents a position of bonding to M1 in Formula (a1).

The charging member according to the present invention has such a configuration, and therefore can prevent generation of strong local discharge (abnormal discharge) even under low temperature and low humidity. The present inventors believe that the charging member according to the present invention can prevent generation of abnormal discharge for the following reasons.

A proximity discharge phenomenon in the air is generated according to the Paschen's law. This phenomenon indicates diffusion of electron avalanche generated through repeated collision of free electrons accelerated in an electric field with molecules present between electrodes and the electrodes to generate electrons, cations and anions. This electron avalanche diffuses according to the electric field, and diffusion determines the final amount of discharge. When an electric field which is more excessive than a condition complying with the Paschen's law is generated, strong local discharge, that is, abnormal discharge will be readily generated.

In particular, a smaller amount of molecules are present between electrodes under low temperature and low humidity than under normal temperature and normal humidity. For this reason, the discharge start voltage under low temperature and low humidity tends to be higher than the discharge start voltage derived from the Paschen's law. Accordingly, an increase in discharge start voltage readily generates an electric field which is more excessive than a condition complying with the Paschen's law, so that abnormal discharge readily occurs under low temperature and low humidity in particular.

It is believed that in the polymetalloxane according to the present invention, the metal atom M1 reacts with the phenolic hydroxyl group of a polymer having a structural unit containing a phenolic hydroxyl group to form a bond "—Z—O-M1" represented by Structural Formulae (a2) and (a3). The polymetalloxane having such a bond has a shallower highest occupied molecular orbital (HOMO) than that of polymetalloxanes not having the bond. The present inventors infer that this shallower highest occupied molecular orbital of the polymetalloxane allows electrons to be readily discharged from the surface layer in the charging member according to the present invention. For this reason, the charging member can have lower discharge start voltage to reduce the amount of discharge. Therefore, the present inventors believe that the charging member can effectively prevent generation of abnormal discharge.

<Charging Member>

Hereinafter, the present invention will be described in detail by way of a charging member in the form of a roller (hereinafter referred to as "charging roller" in some cases) as a specific example of a charging member. The charging member can have any shape, and may have a shape such as a roller or a plate.

A charging roller in FIG. 1 includes a support 1, and an elastic layer 2 and a surface layer 3 formed on the support 1.

The charging member is disposed to be capable of charging the surface of an electrophotographic photosensitive member (hereinafter, also referred as "photosensitive member"). Such a charging member can have a configuration including an elastic layer to sufficiently ensure the contact nip with the photosensitive member. The simplest configuration of the charging member including an elastic layer includes two layers, i.e., an elastic layer and a surface layer disposed on a support. One or two or more other layers may be disposed between the support and the elastic layer or between the elastic layer and the surface layer.

[Surface Layer]

The surface layer contains a polymetalloxane having a structure represented by Structural Formula (a1).

In the polymetalloxane, the metal atom M1 in the polymetalloxane is bonded to a carbon atom in a structural unit represented by Structural Formula (a2) through a linking group represented by Structural Formula (a3):

Structural Formula (a1)

$$M1O_{(k-(s+1))/2}(L1)_s$$

Structural Formula (a2)

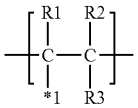

Structural Formula (a3)

where in Formula (a1),

M1 represents a metal atom selected from the group consisting of Ti, Zr, Hf, V, Nb, Ta, W, Al, Ga, In and Ge; s represents an integer of 0 or more and (k−2) or less;

in the case that M1 is Al, Ga or In, then k=3;

in the case that M1 is Ti, Zr, Hf or Ge, then k=4;

in the case that M1 is Nb, Ta or W, then k=5;

in the case that M1 is V, then k=3 or 5; and

L1 represents a ligand having a structure represented by Formula (b) or a ligand having a structure represented by Formula (c);

where in Formula (a2), R1 to R3 each independently represent a hydrogen atom or an alkyl group having 1 to 3 carbon atoms; and a symbol "*1" represents a site of bonding to Z in Formula (a3); and where in Formula (a3), Z represents a substituted or unsubstituted phenylene group, provided that the substituent in the substituted phenylene group is a halogen atom or an alkyl group having 1 to 3 carbon atoms;

a symbol "*1" represents a position of bonding to the symbol "*1" in Formula (a2); and a symbol "*2" represents a position of bonding to M1 in Formula (a1).

The polymetalloxane according to the present invention has a metalloxane structure in which the metal atom M1 is bonded to an oxygen atom. In the polymetalloxane, M1 is any one metal selected from the group consisting of titanium (Ti), zirconium (Zr), hafnium (Hf), vanadium (V), niobium (Nb), tantalum (Ta), tungsten (W), aluminum (Al), gallium (Ga), indium (In) and germanium (Ge).

For example, in the case that M1 is Ti and s=0 in Structural Formula (a1), a metalloxane structure represented by $TiO_{3/2}$ is present in the polymetalloxane. Ti in the metalloxane structure is bonded to a carbon atom in a structural unit represented by Structural Formula (a2) through a linking group represented by Structural Formula (a3). At s=1, a metalloxane structure represented by $TiO_{2/2}(L1)_1$ is present in the polymetalloxane. Ti in the metalloxane structure is coordinated with a ligand represented by Formula (b) or a ligand represented by Formula (c) described later, and is bonded to the carbon atom in a structural unit represented by Structural Formula (a2) through a linking group represented by Structural Formula (a3).

The symbol "s" in Structural Formula (a1) indicating the number of ligands bonded to and coordinated with M1 is preferably an integer of 1 or more and (k−2) or less, particularly preferably 1 or 2. When s is 1 or more, M1 bonded to and coordinated with a ligand having a structure represented by Formula (b) or (c), which will be described in detail later, is present in the polymetalloxane. A charging member including a surface layer containing such a polymetalloxane can more effectively prevent generation of abnormal discharge. This is probably because a polymetalloxane containing M1 bonded to and coordinated with the ligand has a significantly shallower HOMO.

The polymetalloxane according to the present invention may further have a structure represented by Structural Formula (a4). A polymetalloxane having such a structure can control the properties of the surface layer. Examples of controllable properties of the surface layer include smoothness and strength.

$$M1O_{(k-t)/2}(L1)_t$$ Structural Formula (a4)

where in Structural Formula (a4), M1, k and L1 are the same as M1, k and L1 in Structural Formula (a1); and t represents an integer of 0 or more and (k−1) or less.

For example, in the case that M1 is Ti and t=0 in Structural Formula (a4), the polymetalloxane further contains $TiO_{4/2}$.

At t=1, the polymetalloxane further contains $TiO_{3/2}(L1)_1$.

The presence of the metal atom M1 in the polymetalloxane can be verified with an energy dispersion X-ray spectrometer (EDAX), for example. The presence of the metalloxane structure can be verified by a variety of nuclear magnetic resonance (NMR) analyses. M1 in Structural Formula (a1) bonded to a carbon atom in a structural unit represented by Structural Formula (a2) through a linking group represented by Structural Formula (a3) can be verified, for example, from a chemical shift toward a lower magnetic field of the peak attributed to the carbon atom bonded to the hydroxyl group in the phenylene group of poly(vinylphenol) in solid NMR analysis. The details of the method and the conditions of analysis will be described in Examples later.

Next, a ligand having a structure represented by Formula (b) and a ligand having a structure represented by Formula (c) for L1 in Structural Formula (a1) will be described.

<Ligand Having Structure Represented by Formula (b)>

(b)

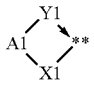

where in Formula (b), a symbol "**" represents a site of bonding to or coordination with the metal atom M1 in the polymetalloxane; and X1 represents one of the structures represented by Formulae (1) to (4):

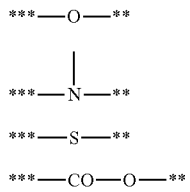

(1)

(2)

(3)

(4)

where in Formulae (1) to (4), a symbol "" represents a site of bonding to the metal atom M1 in the polymetalloxane; and a symbol "*" represents a site of bonding to A1.

In Formula (2), the nitrogen atom may be a nitrogen atom in a heterocyclic skeleton such as a pyrrole skeleton, an indole skeleton, a pyrrolidine skeleton, a carbazole skeleton, an imidazole skeleton, a benzimidazole skeleton, a pyrazole skeleton, an indazole skeleton, a triazole skeleton, a benzotriazole skeleton, a tetrazole skeleton, a pyrrolidone skeleton, a piperidine skeleton, a morpholine skeleton and a piperazine skeleton. These skeletons may have substituents. Examples of the substituents include linear or branched alkyl groups or alkoxy groups having 1 to 10 carbon atom. Those having 1 to 4 carbon atoms are more preferred (the substituents in the subsequent description are the same unless otherwise specified). If the nitrogen atom is not the nitrogen atom in the heterocyclic skeleton, an atom or a group bonded to the nitrogen atom through a moiety other than A1 and M1 represents a hydrogen atom, a substituted or unsubstituted aryl group, or an alkyl group having 1 to 10 carbon atoms. Specifically, examples thereof include aryl groups such as a phenyl group and a naphthyl group; linear alkyl groups such as a methyl group, an ethyl group, a n-propyl group, a n-butyl group, a n-hexyl group, a n-octyl group, a n-nonyl group and a n-decyl group; branched alkyl groups such as an isopropyl group and a t-butyl group; and cyclic alkyl groups such as a cyclopentyl group and a cyclohexyl group. Particularly, the group represented by Formula (2) can be an unsubstituted amino group, monoalkylamino groups having 1 to 4 carbon atoms, or divalent groups having a pyrrole skeleton from which one of hydrogen atoms bonded to a nitrogen atom is removed.

Y1 in Formula (b) represents a group having a site of coordination with M1 in Formula (a), and containing an atom having an unshared electron pair. Specifically, examples thereof include a hydroxy group, an alkoxy group, an aryloxy group, a carbonyl group, a thiol group, an alkylthio group, an arylthio group, a thiocarbonyl group, a substituted or unsubstituted amino group, and a substituted or unsubstituted imino group.

Examples of the alkoxy group include linear or branched alkoxy groups having 1 to 10 carbon atoms. Specifically, examples thereof include a methoxy group, an ethoxy group, a n-propoxy group, an isopropoxy group, a n-butoxy group and a t-butoxy group. Preferred alkoxy groups are those having 1 to 4 carbon atoms.

Examples of the aryloxy group include a phenoxy group and a naphthyloxy group. These groups may have substituents.

Examples of the alkylthio group include alkoxy groups in which an oxygen atom is replaced with a sulfur atom.

Examples of the arylthio group include aryloxy groups in which an oxygen atom is replaced with a sulfur atom.

Examples of the carbonyl group include a formyl group, a carboxyl group, an alkylcarbonyl group, an alkoxycarbonyl group, an arylcarbonyl group, an amide group (R—CO—NR— or R—NR—CO—), a ureido group ($NH_2$—CO—NH—) and a urea group (R—NH—CO—NH—). It is preferred that the alkyl group of the alkylcarbonyl group and the alkoxycarbonyl group, and R of the amide group and the urea group each independently represents a hydrogen atom, or a linear or branched alkyl group having 1 to 10 carbon atoms. Specifically, examples thereof include linear alkyl groups such as a methyl group, an ethyl group, a n-propyl group, a n-butyl group, a n-hexyl group, a n-octyl group, a n-nonyl group and a n-decyl group; and branched alkyl groups such as an isopropyl group and a t-butyl. Those having 1 to 4 carbon atoms are more preferred.

Examples of the arylcarbonyl group include groups having substituted or unsubstituted aromatic hydrocarbons bonded with a carbonyl group, or groups having substituted or unsubstituted aromatic heterocycles bonded with a carbonyl group. Specifically, examples thereof include substituted or unsubstituted phenylcarbonyl and naphthylcarbonyl groups.

Examples of the thiocarbonyl group include groups in which an oxygen atom of the carbonyl group is replaced with a sulfur atom.

Examples of the substituted amino group include an alkylamino group, a dialkylamino group, and a substituted or unsubstituted arylamino group. Specifically, examples thereof include monoalkylamino groups having 1 to 10 carbon atoms such as a monomethylamino group and a monoethylamino group; dialkylamino groups having 1 to 10 carbon atoms such as dimethylamino group, a diethylamino group and a methylethylamino group; and substituted or unsubstituted arylamino groups having 1 to 10 carbon atoms such as a monophenylamino group, a methylphenylamino group, a diphenylamino group and a naphthylamino group.

The unsubstituted imino group is a group represented by >C═NH or N═$CH_2$. The hydrogen atom of the unsubstituted imino group may be replaced with an alkyl group having 1 to 10 carbon atoms or a substituted or unsubstituted aryl group (phenyl group, naphthyl group).

Y1 may be a group having an aliphatic or aromatic heterocyclic skeleton. Examples of aromatic heterocyclic skeletons include a thiophene skeleton, a furan skeleton, a pyridine skeleton, a pyran skeleton, a benzothiophene skeleton, a benzofuran skeleton, a quinoline skeleton, an isoquinoline skeleton, an oxazole skeleton, a benzoxazole skeleton, a triazole skeleton, a benzothiazole skeleton, a thiadiazole skeleton, a benzothiadiazole skeleton, a pyridazin skeleton, a pyrimidine skeleton, a pyrazine skeleton, a phenazine skeleton, an acridine skeleton, a xanthene skeleton, an imidazole skeleton, a benzimidazole skeleton, a pyrazole skeleton, an indazole skeleton, a triazole skeleton, a benzotriazole skeleton and a tetrazole skeleton. These skeletons may have substituents. Examples of aliphatic heterocyclic skeletons include substituted or unsubstituted morpholine skeletons.

Among these groups for Y1, preferred groups are a hydroxy group, an alkoxy group having 1 to 4 carbon atoms, a substituted or unsubstituted phenoxy group, a substituted or unsubstituted naphthyloxy group, a formyl group, an alkylcarbonyl group having an alkyl group having 1 to 4 carbon atoms, an alkoxycarbonyl group having an alkoxy group having 1 to 4 carbon atoms, a thiocarbonyl group, a dimethylamide group, a diethylamide group, an ethylmethylamide group, an unsubstituted amino group, a monomethylamino group, a monoethylamino group, a dimethylamino group, a diethylamino group, a monophenylamino group, a methylethylamino group, a methylphenylamino group, a diphenylamino group, a naphthylamino group, an unsubstituted imino group, a methanimino group, an ethanimino group, a group having a pyridine skeleton, a group having a quinoline skeleton, or a group having an isoquinoline skeleton.

In Formula (b), A1 is a bond or an atomic group needed to form a 4- to 8-membered ring with M1, X1 and Y1. If A1 is an atomic group needed to form a 4- to 8-membered ring with M1, X1 and Y1, examples of the atomic group include the followings: alkylene groups such as a methylene group, an ethylene group, a trimethylene group and a tetramethylene group; alkenylene groups such as a vinylene group, a propenylene group, a butenylene group and a pentenylene group; and atomic groups having a substituted or unsubstituted aromatic ring (a benzene ring, a naphthalene ring, a pyrrole ring, a thiophene ring, a furan ring, a pyridine ring, an indole ring, a benzothiophene ring, a benzofuran ring, a quinoline ring and an isoquinoline ring). A1 is particularly preferably a bond, an alkylene group, or an atomic group having a substituted or unsubstituted aromatic ring (a benzene ring, a naphthalene ring, a pyrrole ring, a pyridine ring, an indole ring, a quinoline ring and an isoquinoline ring). These groups for A1 result in higher stability of the structure represented by Formula (b) and a higher effect of preventing abnormal discharge than those of an alkenylene group for A1.

If A1 is an atomic group having an aromatic ring, A1 may form a condensation ring with one or both of an aromatic heterocycle of Y1 and an aromatic heterocycle of X1.

The ring formed of A1, M1, X1 and Y1 is preferably a 5-membered ring or a 6-membered ring in view of formability of the complex.

Specifically, the ligand represented by Formula (b) is preferably the followings.

If X1 is a ligand represented by Formula (1), the ligand represented by Formula (b) is preferably a structure represented by one of Formulae (5) to (9):

(5)

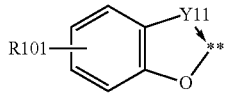

(6)

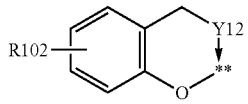

(7)

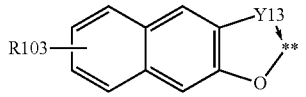

(8)

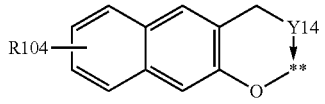

where in Formulae (5) to (8), R101 to R104 are each independently a hydrogen atom, a methoxy group or an ethoxy group; Y11 to Y14 each independently represent a methoxy group, an ethoxy group, a formyl group, a methylcarbonyl group, an ethylcarbonyl group, a methoxycarbonyl group, an ethoxycarbonyl group, a dimethylamide group, a diethylamide group, a methylethylamide group, a methylthio group, an ethylthio group, a thiocarbonyl group, a dimethylamino group, a diethylamino group, an ethylmethylamino group, an unsubstituted imino group, a methanimino group, an ethanimino group, a group having a pyridine skeleton, a group having a quinoline skeleton, or a group having an isoquinoline skeleton; and a symbol "**" represents a site of bonding to the metal atom M1 in the polymetalloxane;

(9)

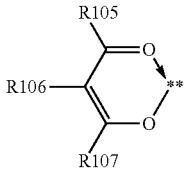

where in Formula (9), R105 is an alkyl group having 1 to 4 carbon atoms, a phenyl group, or a benzyl group; R106 is a hydrogen atom, or an alkyl group having 1 to 4 carbon atoms; R107 is an alkyl group having 1 to 4 carbon atoms, an alkoxy group having 1 to 4 carbon atoms, a phenyl group, or a benzyl group; and a symbol "**" represents a site of bonding to the metal atom M1 in the polymetalloxane.

If X1 is a ligand represented by one of Formulae (2) to (4), a preferred combination of X1, A1 and Y1 is the followings.

A1 is a bond, a methylene group, an ethylene group or a trimethylene group; X1 is a structure represented by one of Formulae (2a) to (2c), (3) and (4); and Y1 is a methoxy group, an ethoxy group, a formyl group, a methylcarbonyl group, an ethylcarbonyl group, a methoxycarbonyl group, an ethoxycarbonyl group, a dimethylamide group, a diethylamide group, a methylethylamide group, a methylthio group, an ethylthio group, a thiocarbonyl group, a dimethylamino group, a diethylamino group, an ethylmethylamino group, an unsubstituted imino group, a methanimino group, an ethanimino group, a group having a pyridine skeleton, a group having a quinoline skeleton, or a group having an isoquinoline skeleton.

(2a)

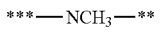

(2b)

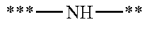

(2c)

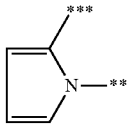

(3)

(4)

where in Formulae (2a) to (2c), (3) and (4), a symbol "" represents a site of bonding to the metal atom M1 in the polymetalloxane; and a symbol "*" represents a site of bonding to A1.

Specific examples of the compounds which can form the ligand L1 in Formula (b) (hereinafter, referred to as "compound for a ligand") are shown in Tables 1 to 4. Some of them will be picked up, and be specifically described.

Examples of the compound for a ligand where X1 is represented by Formula (4) include o-anisic acid represented by Formula (101):

(101)

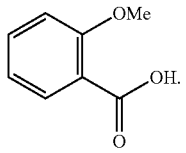

o-Anisic acid forms a complex as follows: hydrogen atoms of the carboxyl group are removed to bond an oxygen atom of the carboxyl group to a metal atom, and the oxygen atom of the methoxy group is coordinated with the metal atom. The residual 1,2-phenylene group corresponds to A1.

If o-anisic acid is mixed with titanium isopropoxide in a molar ratio of 2:1 to form a complex, and the complex is mixed with poly(vinylphenol), it is believed that a structure represented by Formula (102) is formed, for example:

(102)

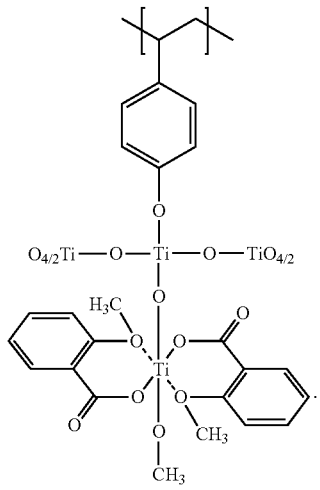

Examples of the compound for a ligand where X1 is represented by Formula (1) include 4-hydroxy-5-azaphenanthrene represented by Formula (103):

(103)

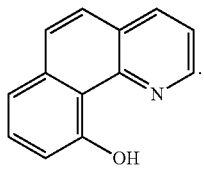

4-Hydroxy-5-azaphenanthrene forms a complex as follows: the hydrogen atom of the hydroxy group is removed to bond the oxygen atom to a metal atom, and the nitrogen atom in the pyridine skeleton is coordinated with the metal atom. The naphthalene skeleton corresponds to A1. The pyridine skeleton and the naphthalene skeleton form a condensation ring, resulting in an azaphenanthrene skeleton.

Examples of the compound for a ligand where X1 is represented by Formula (2) include 2-acetylpyrrole represented by Formula (104):

(104)

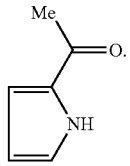

2-Acetylpyrrole forms a complex as follows: the nitrogen atom in the pyrrole skeleton is bonded to a metal atom, and the oxygen atom of the acetyl group is coordinated with the metal atom. The bond between the acetyl group and the pyrrole group corresponds to A1.

Other examples of the compounds for a ligand include a compound for a ligand represented by Formula (9). The following compounds are not illustrated in Tables 1 to 4.

β-Diketones such as acetylacetone, 3-ethyl-2,4-pentanedione, 3,5-heptanedione, 2,2,6,6-tetramethyl-3,5-heptanedione, 2,6-dimethyl-3,5-heptanedione, 6-methyl-2,4-heptanedione, 1-phenyl-1,3-butanedione, 3-phenyl-2,4-pentanedione and 1,3-diphenyl-1,3-propanedione; and β-keto esters such as methyl acetoacetate, methyl 3-oxopentanoate, methyl 4-oxohexanoate, methyl isobutyryl acetate, methyl 4,4-dimethyl-3-oxovalerate, ethyl acetoacetate, tert-butyl acetoacetate, isopropyl acetoacetate, butyl acetoacetate and benzyl acetoacetate.

Among these compounds, for example, in acetylacetone represented by Formula (105), the oxygen atom of the hydroxy group of the enol form corresponds to X1, the methylcarbonyl group corresponds to Y1, and the residue corresponds to A1.

(105)

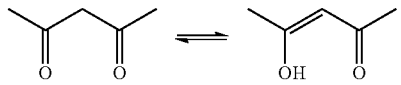

If acetylacetone is mixed with titanium isopropoxide in a molar ratio of 2:1 to form a complex, and the complex is mixed with poly(vinylphenol), it is believed that a structure represented by Formula (106) is formed:

(106)

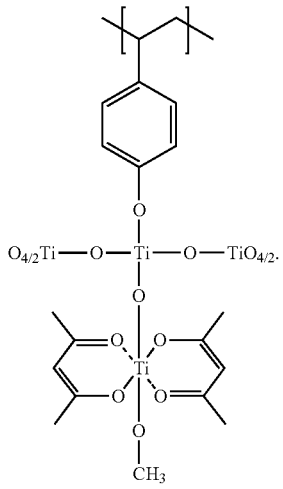

TABLE 1
| X1 and X2 | Y1 and Y2: Hydroxy group Alkoxy group Aryloxy group | Carbonyl group | | | | Alkylthio group Arylthio group | Thiocarbonyl group |
|---|---|---|---|---|---|---|---|
| *—O—** | 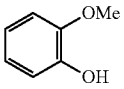 | | | | | 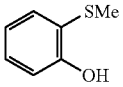 | |
| *—N—** | 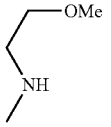 | 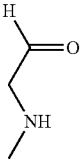 | 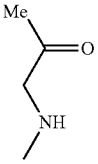 | 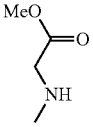 | 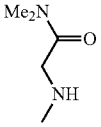 | 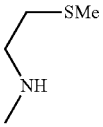 | 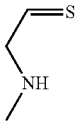 |
| | 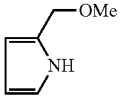 | 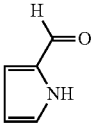 | 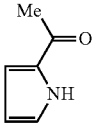 | 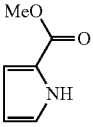 | 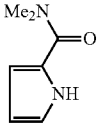 | 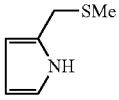 | 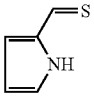 |
| *—S—** | 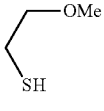 | 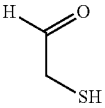 | 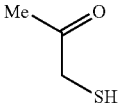 | 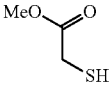 | 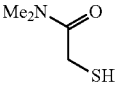 | 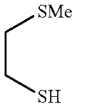 | 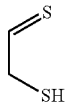 |
| *—CO—O—** | 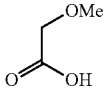 | 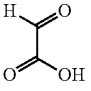 | 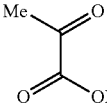 | 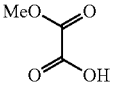 | 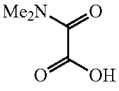 | 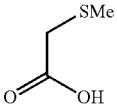 | 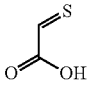 |
TABLE 2
| X1 and X2 | Y1 and Y2: Amino group | Imino group | | Heterocycle | | |
|---|---|---|---|---|---|---|
| *—O—** | 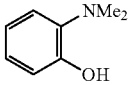 | | 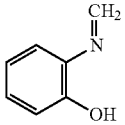 | 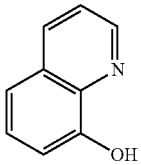 | | |
| *—N—** | 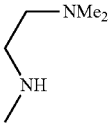 | 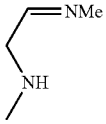 | 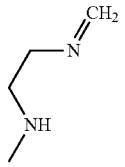 | 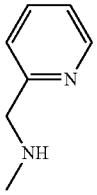 | 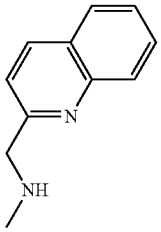 | 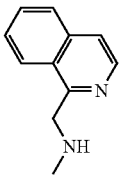 |
| | 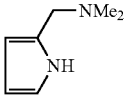 | 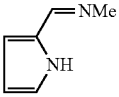 | 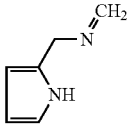 | 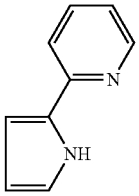 | 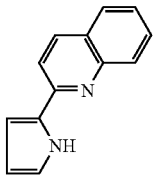 | 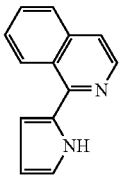 |

TABLE 2-continued
| X1 and X2 | Y1 and Y2 | | | | | |
|---|---|---|---|---|---|---|
| | Amino group | Imino group | | Heterocycle | | |
| *—S—** | 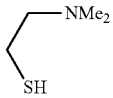 | 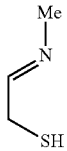 | 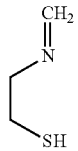 | 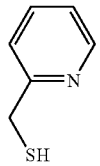 | 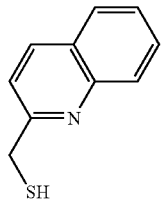 | 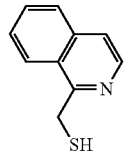 |
| *—CO—O—** | 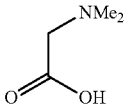 | 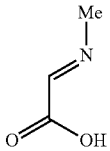 | 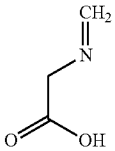 | 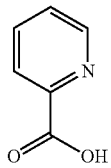 | 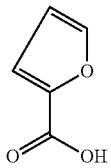 | 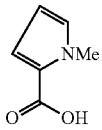 |
| | | | | 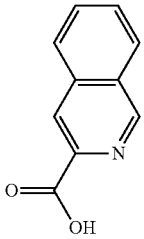 | 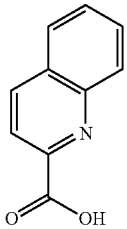 | 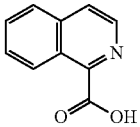 |
TABLE 3
| X1 and X2 | Y1 and Y2 | | | |
|---|---|---|---|---|
| | Hydroxy group<br>Alkoxy group<br>Aryloxy group | Carbonyl group | | |
| *—O—** | 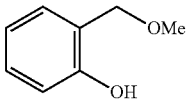 | 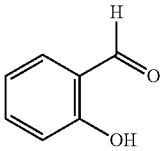 | 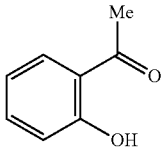 | 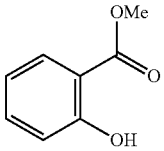 |
| *—N—** | 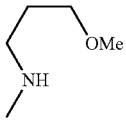 | 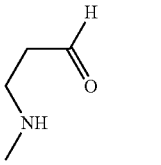 | 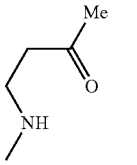 | 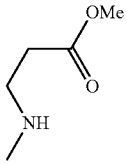 |
| | 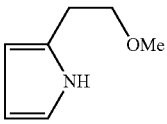 | 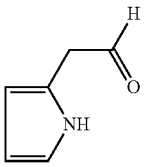 | 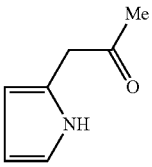 | 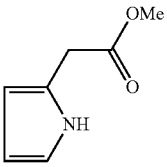 |
| *—S—** | 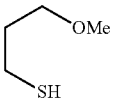 | 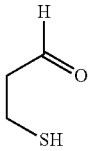 | 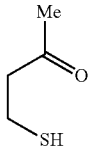 | 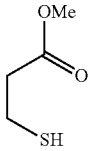 |

TABLE 3-continued
| | | | | |
|---|---|---|---|---|
| *—CO—O—** | 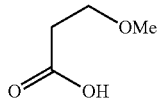 | 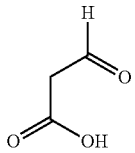 | 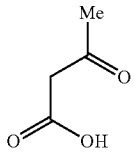 | 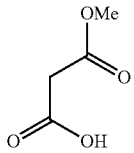 |
| | 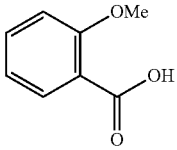 | | | |
| | Y1 and Y2 | | |
|---|---|---|---|
| X1 and X2 | Carbonyl group | Alkythio group Arylthio group | Thiocarbonyl group |
| *—O—** | 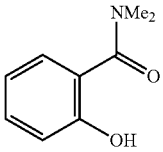 | 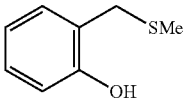 | 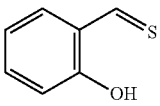 |
| *—N—** | 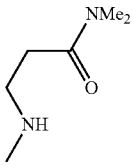 | 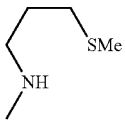 | 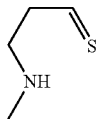 |
| | 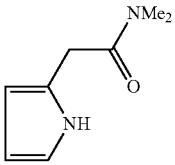 | 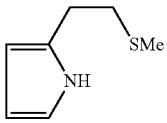 | 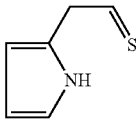 |
| *—S—** | 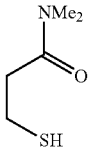 | 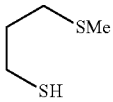 | 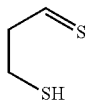 |
| *—CO—O—** | 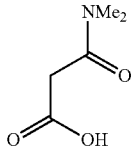 | 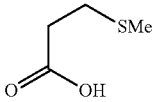 | 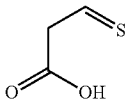 |
| | | 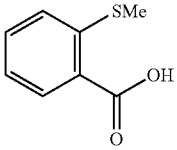 | |

TABLE 4

| X1 and X2 | Y1 and Y2: Amino group | Imino group | | Heterocycle | |
|---|---|---|---|---|---|
| *—O—** | 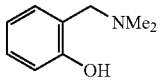 | 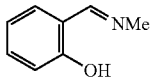 | 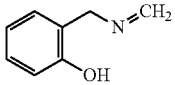 | 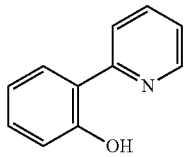 | 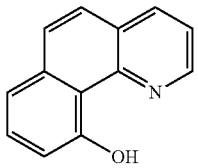 |
| *—N—** | 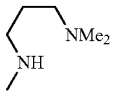 | 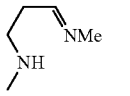 | 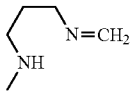 | 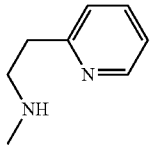 | 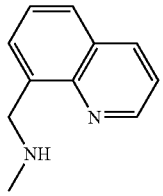 |
| | 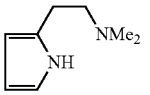 | 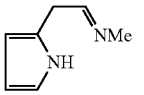 | 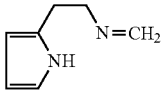 | 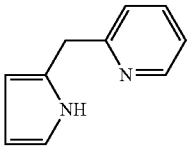 | 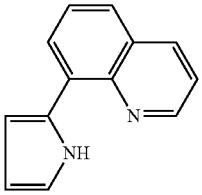 |
| *—S—** | 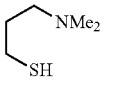 | 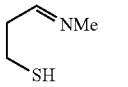 | 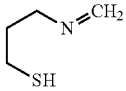 | 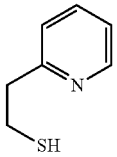 | 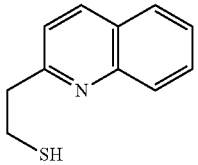 |
| *—CO—O—** | 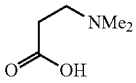 | 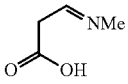 | 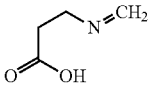 | 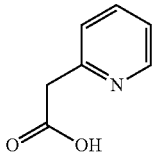 | 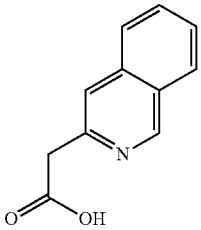 |
| | 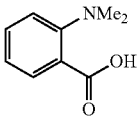 | | | 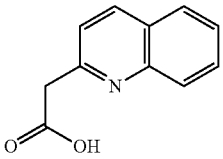 | 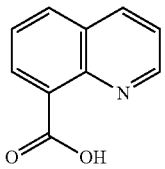 |

<Ligand Having Structure Represented by Formula (c)>

(c)

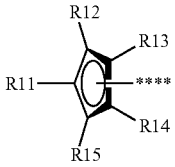

where in Formula (c), R11 to R15 each independently represent a hydrogen atom, an alkyl group having 1 to 4 carbon atoms, or a trimethylsilyl group. R11 to R15 are preferably electron-donating groups to make the highest occupied molecular orbital (HOMO) of the polymetalloxane according to the present invention shallower. Namely, R11 to R15 are preferably a methyl group, a t-butyl group or a trimethylsilyl group.

In Formula (c), a symbol "****" represents a site of coordination with the metal atom M1 in the polymetalloxane.

Specific examples of compounds coordinated with and bonded to a metal atom to form the structure represented by Formula (c) are shown in Table 5. In the structures shown in Table 5, "Me" represents a methyl group.

TABLE 5

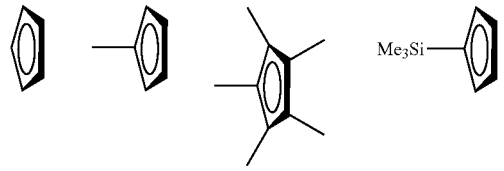

In Formula (b) and Formula (c), the number of ligands L1 coordinated per metal atom is not limited to one. Not only one ligand but also two or more ligands may be coordinated with the metal atom M1.

[Support]

The support brought into contact with the photosensitive member should have sufficient rigidity, and can be formed of a metal material. Specifically, examples of the metal material include iron, copper, stainless steel, aluminum, aluminum alloys and nickel. A support formed of a resin reinforced with a filler can be used.

[Elastic Layer]

The elastic layer can be formed of an elastic material usually used for the elastic layer of the charging member, such as rubber or a thermoplastic elastomer. These materials can be used singly or in combination.

Specifically, examples of the rubber include urethane rubber, silicone rubber, butadiene rubber, isoprene rubber, chloroprene rubber, styrene-butadiene rubber, ethylene-propylene rubber, polynorbornene rubber, acrylonitrile rubber, epichlorohydrin rubber and alkyl ether rubber. Examples of the thermoplastic elastomer include styrene elastomers and olefin elastomers.

The elastic layer can contain an electro-conductive agent to have a predetermined electro-conductivity. The elastic layer has an electric resistance in the range of suitably $1.0\times10^2\Omega$ or more and $1.0\times10^8\Omega$ or less.

Examples of the electro-conductive agent which can be used in the electro-conductive elastic layer include carbon-based materials, metal oxides, metals, cationic surfactants, anionic surfactants, amphoteric surfactants, charge preventing agents and electrolytes.

Specifically, examples of the carbon-based materials include electro-conductive carbon black and graphite. Specifically, examples of the metal oxides include tin oxide, titanium oxide and zinc oxide. Specifically, examples of the metals include nickel, copper, silver and germanium.

Specifically, examples of the cationic surfactants include quaternary ammonium salts (lauryltrimethylammonium, stearyltrimethylammonium, octadodecyltrimethylammonium, dodecyltrimethylammonium, hexadecyltrimethylammonium and modified fatty acids/dimethylethylammonium), perchlorates, chlorates, fluoborates, ethosulfates and halogenated benzyl salts (benzyl bromide salts and benzyl chloride salts).

Specifically, examples of the anionic surfactants include aliphatic sulfonates, higher alcohol sulfate esters, higher alcohol ethylene oxide adducted sulfate esters, higher alcohol phosphate esters and higher alcohol ethylene oxide adducted phosphate esters.

Examples of the charge preventing agents include nonionic charge preventing agents such as higher alcohol ethylene oxides, polyethylene glycol fatty acid esters and polyhydric alcohol fatty acid esters.

Examples of the electrolytes include salts of metals of Group I in the periodic table. Specifically, examples of the salts of metals of Group I in the periodic table include $LiCF_3SO_3$, $NaClO_4$, $LiAsF_6$, $LiBF_4$, NaSCN, KSCN and NaCl.

A salt of a metal of Group II in the periodic table ($Ca(ClO_4)_2$) or a charge preventing agents derived therefrom can also be used as the electro-conductive agent for an electro-conductive elastic layer. Ion electro-conductive electro-conductive agents such as complexes of these salts and polyhydric alcohols (1,4-butanediol, ethylene glycol, polyethylene glycol, propylene glycol, polypropylene glycol) or derivatives thereof, or complexes of these salts and monools (ethylene glycol monomethyl ether, ethylene glycol monoethyl ether) can be used.

The elastic layer can have an MD-1 hardness of 60° or more and 85° or less to prevent deformation of the charging member brought into contact with the photosensitive member to be charged. The elastic layer can have a crown shape, namely, have a thickness of the central portion larger than those of ends of the layer in the direction along with the axial direction to bring the charging member into uniform contact with the photosensitive member in the transverse direction.

The polymetalloxane according to the present invention is prepared through a reaction of

- a polymer having a structural unit containing a phenolic hydroxyl group, and
- a compound having a structure represented by Formula (d). Namely, the polymetalloxane according to the present invention can be defined as a reaction product of the polymer having a structural unit containing a phenolic hydroxyl group with a metal alkoxide having a structure represented by Formula (d). Unlike surface layers formed of a binder resin containing particulate titanium oxide in which the presence of particulate titanium oxide is observed as a crystal structure, any crystal structure is not observed in the surface layer according to the present invention. Namely, according to the present invention, the reaction product of the polymer having a structural unit containing a phenolic hydroxyl group with the compound having a structure represented by Formula (d) is in an amorphous state. The amorphousness of the reaction product can be verified through analysis of the crystal structure by X-ray diffractometer (XRD), for example. The details of the method and the conditions of analysis will be described in the Examples.

Examples of the polymer having a structural unit containing a phenolic hydroxyl group include polymers containing vinylphenol as a structural unit such as poly(vinylphenol) (polyhydroxystyrene), and novolac-type phenolic resins.

$$M2(OR2)q-p(L2)p \quad (d)$$

where in Formula (d), M2 is the same as M1 in Formula (a1), and represents one metal atom selected from the group consisting of Ti, Zr, Hf, V, Nb, Ta, W, Al, Ga, In and Ge; p represents an integer of 0 or more, with the proviso that (q−p) is 2 or more; in p, in the case that M2 is Al, Ga or In, then q=3; in the case that M2 is Ti, Zr, Hf or Ge, then q=4; in the case that M2 is Nb, Ta or W, then q=5; in the case that M2 is V, then q=3 or 5; and R2 represents a hydrocarbon group having 1 to 10 carbon atoms.

On condition that (q−p) is 2 or more, p is preferably an integer of 1 or more, and more preferably, p is 1 or 2. Use of a metal alkoxide having at least one ligand represented by L2, generates a polymetalloxane where s in Structural Formula (a1) is 1 or more. Namely, the metal atom M1 bonded to and coordinated with the ligand represented by Formula (b) or the ligand represented by Formula (c) is present in the polymetalloxane. A charging member including a surface layer containing such a polymetalloxane can more significantly prevent generation of abnormal discharge. It is believed that this is because the polymetalloxane has a shallower HOMO. When p is 2 or more, respective L2 may be different.

R2 is preferably a hydrocarbon group having 1 to 4 carbon atoms.

L2 represents a ligand having a structure represented by Formula (e) or a ligand having a structure represented by Formula (f).

(e)

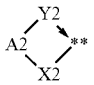

where in Formula (e), a symbol "**" represents a site of bonding to or coordination with the metal atom M2, which is eventually the metal atom M1 in the polymetalloxane. A2 and Y2 are the same as A1 and Y1 described above, respectively. X2 represents one of structures represented by Formulae (10) to (13):

(10)

(11)

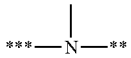

(12)

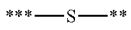

(13)

where in Formulae (10) to (13), a symbol "" represents a site of bonding to the metal atom M2; and a symbol "*" represents a site of bonding to A2. The specific structures represented by Formulae (10) to (13) are each the same as Formulae (1) to (4).

(f)

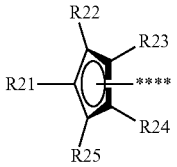

where in Formula (f), a symbol "****" represents a site of coordination with the metal atom M2; and R21 to R25 are each the same as R11 to R15 defined above.

Here, the polymetalloxane further having the structure represented by the formula (a4), where t in the formula (a4) is "k−1", can be obtained by co-existing a compound represented by the formula (d') in a reaction system including the polymer having a structural unit containing a phenolic hydroxyl group, and a compound having a structure represented by Formula (d)

$$M2(OR2)_{q-p'}(L2)_{p'} \quad (d')$$

where in Formula (d'), p' represents an integer of (q−1).

[Formation of Surface Layer]

The surface layer according to the present invention is formed through the following steps (i) to (iii):

(i) a step of preparing a coating liquid for forming a surface layer, (ii) a step of forming a coating of the coating liquid, and (iii) a step of drying the coating.

(i) Step of Preparing Coating Liquid

The coating liquid can be prepared through the following steps 1 and 2.

<Step 1>

Step 1 is a step of preparing a solution of raw materials forming the coating liquid.

Specifically, a solution of a polymer having a structural unit containing a phenolic hydroxyl group (hereinafter, referred as "polymer solution"). A solution of the compound represented by Formula (d) (hereinafter, referred as "metal alkoxide solution") is prepared.

If a compound where p is 1 or more, namely, a compound having the ligand L2 coordinated with the metal atom M2 is used as the compound represented by Formula (d), the solution of the compound represented by Formula (d) where M2 is coordinated with the ligand L2 can be prepared as follows: for example, a solution of a metal alkoxide as a raw material not having a coordinated ligand L2 and a solution of raw materials for the ligand L2 are each prepared, and are mixed. In this case, the compound for a ligand is added in an amount of preferably 0.5 mol or more, more preferably 1 mol or more to 1 mol of the metal alkoxide as the raw material. Several compounds or metal alkoxides can be used in combination. In Formula (e) and Formula (f), the number of ligands L2 coordinated per metal atom is not limited to one. The metal atom M2 may be coordinated with one ligand or with two or more ligands.

If available, a metal alkoxide coordinated with a compound for a ligand is purchased, and can be used as it is.

If a compound where p is 0 is used as the compound represented by Formula (d), the compound represented by Formula (d) corresponds to the metal alkoxide as the raw material.

Examples of the metal alkoxide usable as a raw material where M2 is not coordinated with L2 include alkoxides of titanium, zirconium, hafnium, vanadium, niobium, tantalum, tungsten, aluminum, gallium, indium and germanium.

Examples of the alkoxides include alkoxides having 1 to 10 carbon atoms such as methoxide, ethoxide, n-propoxide, iso-propoxide, n-butoxide, 2-butoxide and t-butoxide. Preferred alkoxides are those having 1 to 4 carbon atoms.

<Step 2>

Step 2 is a step of mixing the polymer solution prepared in Step 1 with the metal alkoxide solution prepared in Step 1 to prepare a coating liquid.

In Step 2, in mixing of the polymer solution with the metal alkoxide solution, preferably 0.01 mol or more, more preferably 0.1 mol or more of the compound represented by Formula (d) is added to the polymer having a structural unit containing a phenolic hydroxyl group.

An alkoxysilane may be added to the coating liquid, for example, to introduce the structure represented by Formula (a4) into the polymetalloxane to modify the surface layer. Examples of the alkoxysilane include tetraalkoxysilane, trialkoxysilane and dialkoxysilane.

Specific examples of the tetraalkoxysilane include tetramethoxysilane, tetraethoxysilane, tetra(n-propoxy)silane, tetra(iso-propoxy)silane, tetra(n-butoxy)silane, tetra(2-butoxy)silane and tetra(t-butoxy)silane.

Examples of the trialkoxysilane include trimethoxysilanes and triethoxysilanes.

Specific examples of the trimethoxysilanes include trimethoxyhydrosilane, trimethoxymethylsilane, trimethoxyethylsilane, trimethoxy(n-propyl)silane, trimethoxy(iso-propoxy)silane, trimethoxy(n-butoxy)silane, trimethoxy(2-butoxy)silane, trimethoxy(t-butoxy)silane, trimethoxy(n-hexyl)silane, trimethoxy(n-octyl)silane, trimethoxy(n-decyl)silane, trimethoxy(n-dodecyl)silane, trimethoxy(n-tetradecyl)silane, trimethoxy(n-pentadecyl)silane, trimethoxy(n-hexadecyl)silane, trimethoxy(n-octadecyl)silane, trimethoxycyclohexylsilane, trimethoxyphenylsilane and trimethoxy(3-glycidylpropyl)silane.

Specific examples of the triethoxysilanes include triethoxyhydrosilane, triethoxymethylsilane, triethoxyethylsilane, triethoxy(n-propyl)silane, triethoxy(iso-propoxy)silane, triethoxy(n-butoxy)silane, triethoxy(2-butoxy)silane, triethoxy(t-butoxy)silane, triethoxy(n-hexyl)silane, triethoxy(n-octyl)silane, triethoxy(n-decyl)silane, triethoxy(n-dodecyl)silane, triethoxy(n-tetradecyl)silane, triethoxy(n-pentadecyl)silane, triethoxy(n-hexadecyl)silane, triethoxy (n-octadecyl)silane, triethoxycyclohexylsilane, triethoxyphenylsilane and triethoxy(3-glycidylpropyl)silane.

Examples of the dialkoxysilanes include dimethoxysilanes and diethoxysilanes.

Specific examples of the dimethoxysilanes include dimethoxydimethylsilane, dimethoxydiethylsilane, dimethoxymethylphenylsilane, dimethoxydiphenylsilane and dimethoxy (bis-3-glycidylpropyl)silane.

Specific examples of the diethoxysilanes include diethoxydimethylsilane, diethoxydiethylsilane, diethoxymethylphenylsilane, diethoxydiphenylsilane and diethoxy (bis-3-glycidylpropyl)silane.

Any organic solvent which can dissolve the metal alkoxide and the compound listed above can be used without limitation, and alcohol solvents, ether solvents, cellosolve solvents, ketone solvents and ester solvents can be used. Specifically, examples of the alcohol solvents include methanol, ethanol, n-propanol, isopropanol, 1-butanol, 2-butanol, t-butanol, 1-pentanol and cyclohexanol. Specifically, examples of the ether solvents include dimethoxyethane. Specifically, examples of the cellosolve solvents include methyl cellosolve and ethyl cellosolve. Specifically, examples of the ketone solvents include acetone, methyl ethyl ketone and methyl iso-butyl ketone. Specifically, examples of the ester solvents include methyl acetate and ethyl acetate. These organic solvents can be used singly or in the form of a mixture thereof.

(ii) Step of Forming Coating of Coating Liquid

The coating of the coating liquid prepared in Step (i) can be formed by any method of forming a coating generally used. Specifically, examples thereof include coating with a roll coater, immersion coating, and ring coating.

(iii) Step of Drying Coating

The coating of the coating liquid is dried to form the surface layer according to the present invention. The coating may be dried by heating.

In Step 2 of step (i) to step (iii), the compound represented by Formula (d) in the coating liquid is fed to the two reactions below.

- a reaction in which alkoxy groups in the compound represented by Formula (d) are converted into hydroxyl groups through hydrolysis, and the generated hydroxyl groups are condensed with each other to generate a metalloxane bond.
- a reaction in which the metal atom M2 of the compound represented by Formula (d) reacts with the phenolic hydroxyl groups in the polymer to bond to the polymer through a linking group represented by Formula (a3).

As a result, a surface layer containing the polymetalloxane according to the present invention is formed.

Hydrolysis of the compound represented by Formula (d) is promoted by a slight amount of water contained in the organic solvent used in preparation of the coating liquid or water in the air taken into the coating liquid or the coating. The degrees of hydrolysis and condensation may be controlled through addition of water to the coating liquid.

The surface of the coating during the drying step or the surface of the surface layer after drying may be treated to control the surface physical properties such as the friction coefficient of the surface of the surface layer or surface free energy. Examples of such a treatment include a method of irradiating the surface with active energy beams. Examples of the active energy beams include ultraviolet light, infrared radiations and electron beams. Among these methods, use of ultraviolet light is preferred. The surface can be irradiated with ultraviolet light such that the accumulated amount of light is 5000 J/cm$^2$ or more and 10000 J/cm$^2$ or less.

The surface layer has a thickness of preferably 0.005 μm to 30 μm, more preferably 0.005 μm to 5 μm.

The interaction between the polymer having a structural unit containing a phenolic hydroxyl group and the metal alkoxide can be verified by solid NMR analysis.

<Electrophotographic Apparatus and Process Cartridge>

Figure 2:
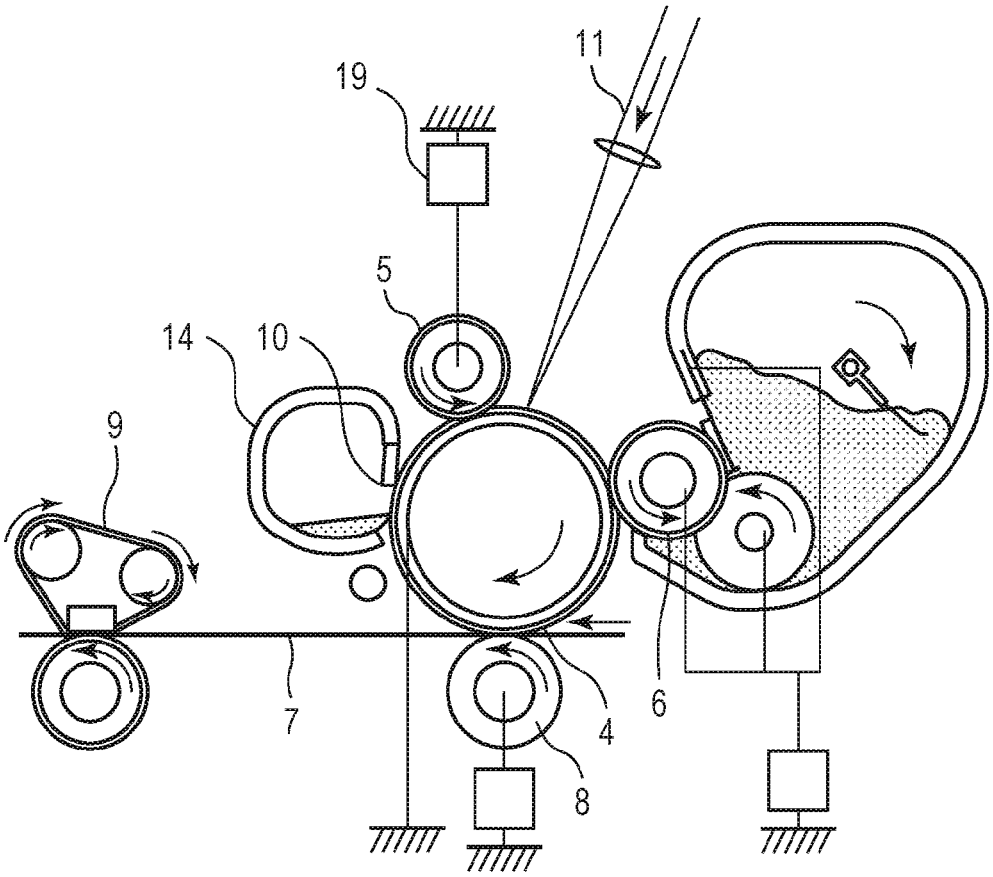
FIG. 2 is a cross-sectional view of an example of the electrophotographic apparatus according to the present invention.
Figure 3:
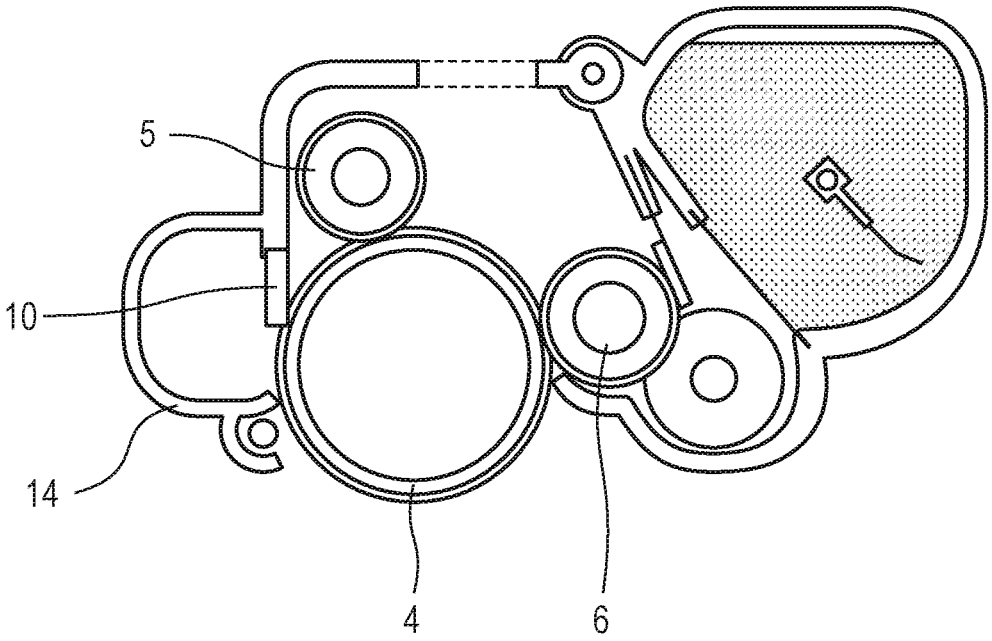
FIG. 3 is a cross-sectional view of an example of the process cartridge according to the present invention.

An example of an electrophotographic apparatus including the charging member according to the present invention is illustrated in FIG. 2, and an example of a process cartridge including the charging member according to the present invention is illustrated in FIG. 3. A photosensitive member 4 is an image bearing member in the form of a rotary drum. The photosensitive member 4 rotates clockwise indicated by the arrow in the diagram, and is driven at a predetermined circumferential speed.

A charging member 5 having a roller shape (hereafter, also refer to "charging roller") is in contact with the surface of the photosensitive member 4 under a predetermined pressure. And, the charging roller 5 rotates in the forward direction of the rotation of the photosensitive member 4. A predetermined DC voltage is applied to the charging roller 5 by the charge bias applying power supply 19 (DC charging method). Note that, in the Examples described later, the DC voltage applied to the charging roller was set to −1050 V. Thereby, the surface of the photosensitive member 4 is uniformly charged at a predetermined polarity potential. Note that, in the Examples described later, dark portion potential was set to −500 V.

An image exposure light 11 corresponding to the information on the target image is irradiated to the charged surface of the photosensitive member 4 from an exposing device (not illustrated). As a result, the potentials of the bright portions of the charged surface of the photosensitive member 4 are selectively reduced (decayed) to form an electrostatic latent image on the photosensitive member 4. Note that, in the Examples described later, bright portion potential was set to −150 V. A known exposing device, such as a laser beam scanner, can be used as the not illustrated exposing device.

A developing roller 6 selectively applies a toner charged to have the same polarity as that of the photosensitive member 4 (negative toner) onto the exposure bright portions of the electrostatic latent image on the surface of the photosensitive member 4 to visualize the electrostatic latent image as a toner image. The developing bias was −400 V in the Examples described later. Any developing method can be used, for example, a jumping developing method, a contact developing method and a magnetic brush method. The contact developing method is particularly preferred for electrophotographic apparatuses outputting color images in terms of being able to suppress scattering of the toner, effectively.

A transfer roller 8 is in contact with the photosensitive member 4 under a predetermined pressure, and rotates in the forward direction of the rotation of the photosensitive member 4 at substantially the same circumferential speed as the circumferential speed of the rotation of the photosensitive member 4. A transfer voltage having a polarity opposite to that of the charge of the toner is applied from a transfer bias applying power supply. A transfer medium 7 is fed to the contact portion between the photosensitive member 4 and the transfer roller 8 from a sheet feeding mechanism (not illustrated) at a predetermined timing. The rear surface of the transfer medium 7 is charged at a polarity opposite to the polarity of the charge of the toner by the transfer roller 8 to which the transfer voltage is applied. The toner image on the surface of the photosensitive member is electrostatically transferred onto the surface of the transfer medium 7 in the contact portion between the photosensitive member 4 and the transfer roller 8. Any known unit can be used as the transfer roller 8. Specifically, examples thereof include transfer rollers including electro-conductive supports made of metals and coated with elastic layers having adjusted middle resistance.

The transfer medium 7 having the transferred toner image is separated from the surface of the photosensitive member, and is introduced into a fixing device 9. The toner image is fixed, and the transfer medium is output as an image formed product. In a double-sided image forming mode or a multiplex image forming mode, this image formed product is introduced into a recirculating transport mechanism (not illustrated) to be reintroduced into a transfer portion. The transfer residual toner on the photosensitive member 4 is recovered from the photosensitive member 4 by a cleaning having a cleaning blade 10. If the photosensitive member 4 has the residual charge, the residual charge of the photosensitive member 4 should be removed by a pre-exposing device (not illustrated) after transfer and before primary charge by the charging roller 5. The apparatus used in image formation in the Examples described later did not include a pre-exposing device.

The process cartridge according to the present invention is configured to be detachably attachable to the main body of an electrophotographic apparatus and integrally supports at least a charging member and a photosensitive member. The process cartridge used in the Examples described later integrally supports the charging roller 5, the photosensitive member 4, the developing roller 6 and the cleaning device 14.

One aspect of the present invention can provide a charging member which has high charging ability, and can prevent generation of strong local discharge (abnormal discharge) even under low temperature and low humidity. Another aspect of the present invention can provide a process cartridge and electrophotographic apparatus which can prevent generation of strong local discharge (abnormal discharge) under low temperature and low humidity, and can form electrophotographic images with high quality.

EXAMPLES

Hereinafter, the present invention will be described in more detail by way of specific Examples. In the description of the compounds in the Examples, "parts" indicates "parts by mass" unless otherwise specified.

A list of the reagents used in the Examples is shown in Table 6.

TABLE 6

| Symbol | Name | CAS No. | Manufacturer | Notes |
|---|---|---|---|---|
| S1 | 2-Butanol | 78-92-2 | KANTO CHEMICAL CO., INC. | Special grade |
| S2 | Ethanol | 64-17-5 | KISHIDA CHEMICAL Co., Ltd. | Special grade |
| S3 | Methyl isobutyl ketone | 108-10-1 | KISHIDA CHEMICAL Co., Ltd. | First grade |
| S4 | Dimethoxyethane | 110-71-4 | KISHIDA CHEMICAL Co., Ltd. | Special grade |
| S5 | Ion-exchanged water | — | KYOEI PHARMACEUTICAL CO., LTD. | on exchange + distillation |
| S6 | Isopropyl alcohol | 67-63-0 | KISHIDA CHEMICAL Co., Ltd. | Special grade |
| P1 | Poly(vinylphenol) | 24979-70-2 | Sigma-Aldrich Corporation | Weight average molecular weight (Mw): up to 25000 |
| P2 | Poly(p-vinylphenol) "MARUKA LYNCUR-M S-1P" | 24979-70-2 | Maruzen Petrochemical Co., Ltd. | Weight average molecular weight (Mw): 1600 to 2400 |
| P3 | Poly(p-vinylphenol) "MARUKA LYNCUR-M S-2P" | 24979-70-2 | Maruzen Petrochemical Co., Ltd. | Weight average molecular weight (Mw): 4000 to 6000 |
| P4 | Poly(p-vinylphenol) "MARUKA LYNCUR-M H-2P" | 24979-70-2 | Maruzen Petrochemical Co., Ltd. | Weight average molecular weight (Mw): 19800 to 24200 |
| P5 | Poly(p-vinylphenol) "MARUKA LYNCUR- CST-70" | 24979-74-6 | Maruzen Petrochemical Co., Ltd. | Type of copolymerization (copolymerized component: Styrene) Content of p-vinylphenol: 50 mol % Weight average molecular weight (Mw): 3000 to 5000 |
| P6 | Novolac-type phenolic resin "TD-2090-60M" | 9003-35-4 | DIC Corporation | 60 wt % methyl ethyl ketone solution |
| MA1 | Titanium isopropoxide | 546-68-9 | KISHIDA CHEMICAL Co., Ltd. | |
| MO1 | Titanium oxide CR-EL | 13463-67-7 | Ishihara Sangyo Kaisha, Ltd. | |
| MA2 | Titanium diisopropoxide bis(acetylacetonate) | 17927-72-9 | Tokyo Chemical Industry Co., Ltd. | 75 wt % isopropanol solution |
| MA3 | Tantalum tetraethoxy acetylacetonate | 20219-33-4 | Gelest Inc., | |
| MA4 | Aluminum di(s-butoxide)ethylacetoacetate | 24772-51-8 | Gelest Inc., | |
| MA5 | Pentamethylcyclopentadienyltitanium trimethoxide | 123927-75-3 | J & K SCIENTIFIC Ltd., | |
| L1 | o-Anisic acid | 579-75-9 | Tokyo Chemical Industry Co., Ltd. | |
| L2 | Guaiacol | 90-5-1 | Tokyo Chemical Industry Co., Ltd. | |
| L3 | Quinaldic acid | 93-10-7 | Tokyo Chemical Industry Co., Ltd. | |

TABLE 6-continued

| Symbol | Name | CAS No. | Manufacturer | Notes |
|---|---|---|---|---|
| L4 | 2-Acetylpyrrole | 1072-83-9 | Tokyo Chemical Industry Co., Ltd. | |
| L5 | N,N-Dimethylglycine | 1118-68-9 | Tokyo Chemical Industry Co., Ltd. | |

(Preparation of Coating Liquid and Structural Analysis)

[Coating Liquid E1]

(Step 1)

<Preparation of Solution of Compound Having Phenolic Hydroxyl Group>

Methyl isobutyl ketone (99.0 g) and poly(vinylphenol) (1.01 g) were placed in a 200 mL glass container, and were stirred to prepare a solution of poly(vinylphenol) in methyl isobutyl ketone.

<Preparation of Solution of Metal Alkoxide>

Ethanol (15.1 g) and titanium isopropoxide (0.39 g) were placed in a 100 mL glass container, and were stirred to prepare a solution of titanium isopropoxide in ethanol.

<Preparation of Solution of Compound for Ligand> o-Anisic acid (0.42 g) and ethanol (34.2 g) were placed in a 100 mL glass container, and were stirred to prepare a solution of o-anisic acid in ethanol.

<Preparation of Solution of Metal Complex>

The solution of titanium isopropoxide in ethanol and the solution of o-anisic acid in ethanol prepared above were added, and were mixed with stirring. It is believed that titanoxane bonds are formed due to hydrolysis and condensation reactions of titanium isopropoxide, and o-anisic acid is coordinated with a titanium atom to form a complex in the solution prepared in this step.

(Step 2)

The solution (35.0 g) of poly(vinylphenol) in methyl isobutyl ketone prepared in STEP 1 and the solution (15.0 g) of a metal complex prepared in STEP 1 were placed in a 100 mL glass container, and were stirred to prepare Coating liquid E1.

[Coating Liquid C1]

Methyl isobutyl ketone (99.0 g) and poly(vinylphenol) (1.01 g) were placed in a 200 mL glass container, and were stirred to prepare coating liquid C1.

[Coating Liquid C2]

<Preparation of Solution of Metal Alkoxide>

Ethanol (15.1 g) and titanium isopropoxide (0.39 g) were placed in a 100 mL glass container, and were stirred to prepare a solution of titanium isopropoxide in ethanol.

<Preparation of Solution of Compound for Ligand> o-Anisic acid (0.42 g) and ethanol (34.2 g) were placed in a 100 mL glass container, and were stirred to prepare a solution of o-anisic acid in ethanol.

<Preparation of Solution of Metal Complex>

The solution of o-anisic acid in ethanol was added to the solution of titanium isopropoxide in ethanol prepared above, and was sufficiently stirred to prepare coating liquid C2.

[Coating Liquid E2]

(Step 1)

<Preparation of Solution of Compound Having Phenolic Hydroxyl Group>

Poly(vinylphenol) (0.45 g) and dimethoxyethane (44.6 g) were weighed, were placed in a 100 mL glass container, and were stirred to prepare a solution of poly(vinylphenol) in dimethoxyethane.

<Preparation of Solution of Metal Alkoxide>

2-Butanol (48.3 g) and titanium isopropoxide (1.78 g) were weighed, were placed in a 100 mL glass container, and were stirred to prepare a solution of titanium isopropoxide in 2-butanol.

(Step 2)

The solution (45.0 g) of poly(vinylphenol) in dimethoxyethane and the solution (5.0 g) of titanium isopropoxide in 2-butanol prepared above were placed in a 100 mL glass container, and were stirred to prepare coating liquid E2.

[Coating Liquid C3]

2-Butanol (48.3 g) and titanium isopropoxide (1.78 g) were weighed, were placed in a 100 mL glass container, and were stirred to prepare coating liquid C3.

[Coating Liquid C4]

Poly(vinylphenol) (0.45 g), dimethoxyethane (44.6 g) and rutile type titanium oxide CR-EL (manufactured by Ishihara Sangyo Kaisha, Ltd.) (0.051 g) were weighed, were placed in a 100 mL glass container, and were sufficiently stirred to prepare coating liquid C4.

[Coating Liquids E3 to E6]

Step 1

<Preparation of Solution of Compound Having Phenolic Hydroxyl Group>

A solution of a compound having a phenolic hydroxyl group was prepared in the same manner as in preparation of the solution of a compound having a phenolic hydroxyl group in STEP 1 in preparation of coating liquid E1 except that the amount of poly(vinylphenol) was changed to 1.00 g.

<Preparation of Solution of Metal Complex>

Isopropyl alcohol (48.3 g) and titanium diisopropoxide bis(acetylacetonate) (1.78 g) were weighed, were placed in a 100 mL glass container, and were stirred to prepare a solution of titanium diisopropoxide bis(acetylacetonate) in isopropyl alcohol. Titanium diisopropoxide bis(acetylacetonate) is a compound having a titanium atom coordinated with acetylacetone. The solution prepared in this step is a solution of a metal alkoxide and a solution of a metal complex.

Step 2

<Preparation of Coating Liquid>

Coating liquid E3 was prepared in the same manner as in coating liquid E1 except that the solution of titanium diisopropoxide bis(acetylacetonate) in isopropyl alcohol was used as the solution of a metal complex, and the quantitative relationship with the solution of a compound having a phenolic hydroxyl group was varied as shown in "STEP 2" in Table 7.

Coating liquids E4 to E6 were prepared in the same manner as in coating liquid E3 except that the amounts of the solution of a compound having a phenolic hydroxyl group and the solution of a metal complex mixed in STEP 2 were varied as shown in "STEP 2" in Table 7.

[Coating Liquid C5]

Isopropyl alcohol (48.3 g) and titanium diisopropoxide bis(acetylacetonate) (1.78 g) were weighed, were placed in a 100 mL glass container, and were stirred to prepare coating liquid C5.

[Coating Liquids E7 to E9]

<Preparation of Solution of Compound Having Phenolic Hydroxyl Group>

Solutions of a compound having a phenolic hydroxyl group were prepared in the same manner as in the solution of a compound having a phenolic hydroxyl group according to coating liquid E1 except that symbols "P2," "P3" and "P4" in Table 6 were used as the compound having a phenolic hydroxyl group in amounts shown in Table 7, and the amount of methyl isobutyl ketone for coating liquid E7 was changed from 99.0 g to 99.1 g.

<Preparation of Solution of Metal Complex>

A solution of a metal complex was prepared in the same manner as in preparation of the solution of a metal complex according to coating liquid E1 except that the amount of ethanol was changed from 15.1 g to 15.0 g.

<Preparation of Coating Liquid>

Coating liquids E7 to E9 were prepared in the same manner as in coating liquid E1 except that the resulting solutions of a compound having a phenolic hydroxyl group were used, and the resulting solution of a metal complex was used.

[Coating Liquids C6 to C8]

Coating liquids C6 to C8 were prepared in the same manner as in coating liquid C1 except that symbols "P2," "P3" and "P4" in Table 6 were used as the compound having a phenolic hydroxyl group in amounts shown in Table 8, and the amount of methyl isobutyl ketone for coating liquid C6 was changed from 99.0 g to 99.1 g.

[Coating Liquids E10 and E11]

<Preparation of Solution of Compound Having Phenolic Hydroxyl Group>

Solutions of a compound having a phenolic hydroxyl group in methyl isobutyl ketone were prepared in the same manner as in the solution of a compound having a phenolic hydroxyl group according to coating liquid E1 except that symbols "P5" and "P6" in Table 6 were used as the compound having a phenolic hydroxyl group in amounts shown in Table 7, and the amount of methyl isobutyl ketone for coating liquid E10 was changed from 99.0 g to 99.1 g.

<Preparation of Solution of Metal Complex>

A solution of a metal complex was prepared in the same manner as in preparation of the solution of a metal complex according to coating liquid E1 except that the amount of ethanol in preparation of the solution of a metal alkoxide was changed from 15.1 g to 15.0 g, and the amount of ethanol in preparation of the solution of a compound for a ligand was changed from 34.2 g to 34.3 g.

<Preparation of Coating Liquid>

Coating liquids E10 and E11 were prepared in the same manner as in coating liquid E1 except that the resulting solution of a compound having a phenolic hydroxyl group in methyl isobutyl ketone and the resulting solution of a metal complex were used, and the quantitative relationships of the solution of a metal complex and the solution of a compound having a phenolic hydroxyl group were varied as shown in "STEP 2" in Table 7.

[Coating Liquids C9 and C10]

Coating liquids C9 and C10 were prepared in the same manner as in coating liquid C1 except that that symbols "P5" and "P6" in Table 6 were used as the compound having a phenolic hydroxyl group in amounts shown in Table 8, and the amount of methyl isobutyl ketone for coating liquid C10 was changed from 99.0 g to 99.1 g.

[Coating Liquid E12]

(Step 1)

<Preparation of Solution of Compound Having Phenolic Hydroxyl Group>

Poly(vinylphenol) (0.45 g) and 2-butanol (44.6 g) were placed in a 100 mL glass container, and were stirred to prepare a solution of poly(vinylphenol) in 2-butanol.

<Preparation of Solution of Metal Complex>

Tantalum tetraethoxy acetylacetonate (0.74 g) and 2-butanol (49.3 g) were placed in a 100 mL glass container, and were stirred to prepare a solution of tantalum tetraethoxy acetylacetonate in 2-butanol. Tantalum tetraethoxy acetylacetonate is a compound having a tantalum atom coordinated with acetylacetone. Accordingly, the solution prepared in this step is a solution of a metal alkoxide and a solution of a metal complex.

(Step 2)

<Preparation of Coating Liquid>

The solution (35.0 g) of poly(vinylphenol) in 2-butanol and the solution (15.0 g) of tantalum tetraethoxy acetylacetonate in 2-butanol prepared above were placed in a 100 mL glass container, and were stirred to prepare coating liquid E12.

[Coating Liquid E13]

(Step 1)

<Preparation of Solution of Compound Having Phenolic Hydroxyl Group>

Poly(vinylphenol) (0.44 g) and 2-butanol (44.5 g) were placed in a 100 mL glass container, and were stirred to prepare a solution of poly(vinylphenol) in 2-butanol.

<Preparation of Solution of Metal Complex>

Aluminum di(s-butoxide)ethylacetoacetate (1.34 g) and 2-butanol (48.6 g) were placed in a 100 mL glass container, and were stirred to prepare a solution of aluminum di(s-butoxide)ethylacetoacetate in 2-butanol.

Aluminum di(s-butoxide)ethylacetoacetate is a compound having an aluminum atom coordinated with acetoacetate ester. Accordingly, the solution prepared in this step is a solution of a metal alkoxide and a solution of a metal complex.

(Step 2)

<Preparation of Coating Liquid>

The solution (35.0 g) of poly(vinylphenol) in 2-butanol and the solution (15.0 g) of aluminum di(s-butoxide)ethylacetoacetate in 2-butanol prepared above were placed in a 100 mL glass container, and were stirred to prepare coating liquid E13.

[Coating Liquid C11]

Tantalum tetraethoxy acetylacetonate (0.73 g) and 2-butanol (49.3 g) were placed in a 100 mL glass container, and were stirred to prepare coating liquid C11.

[Coating Liquid C12]

Aluminum di(s-butoxide)ethylacetoacetate (1.33 g) and 2-butanol (48.6 g) were placed in a 100 mL glass container, and were stirred to prepare coating liquid C12.

[Coating Liquids E14 to E16]

Step 1

<Preparation of Solution of Compound Having Phenolic Hydroxyl Group>

A solution of a compound having a phenolic hydroxyl group was prepared in the same manner as in preparation of the solution of a compound having a phenolic hydroxyl group in STEP 1 in preparation of coating liquid E1 except that the amount of poly(vinylphenol) was changed to 1.00 g.

<Preparation of Solution of Metal Alkoxide>

The amounts of titanium isopropoxide and the solvent used in preparation of the solution of titanium isopropoxide in ethanol in STEP 1 in preparation of coating liquid E1 were varied as shown in Table 7. Except for these, three solutions of a metal alkoxide were prepared in the same manner as in preparation of the solution of a metal alkoxide in preparation of coating liquid E1.

<Preparation of Solution of Compound for Ligand>

The amounts of the compound for a ligand and the solvent in preparation of the solution of a compound for a ligand in STEP 1 in preparation of coating liquid E1 were varied as shown in Table 7. Except for these, a solution of a compound for a ligand was prepared in the same manner as in preparation of the solution of a compound for a ligand in preparation of coating liquid E1.

<Preparation of Solution of Metal Complex>

Three solutions of a metal complex were prepared in the same manner as in preparation of the solution of a metal complex in STEP 1 in preparation of coating liquid E1 except that the three solutions of a metal alkoxide and the solution of a compound for a ligand were used.

Step 2

<Preparation of Coating Liquid>

Coating liquids E14 to E16 were prepared in the same manner as in coating liquid E1 except that the solution of a compound having a phenolic hydroxyl group and the three solutions of a metal complex prepared above were mixed in amounts shown in "STEP 2" in Table 7.

[Coating Liquids E11 to E20]

Step 1

<Preparation of Solution of Compound Having Phenolic Hydroxyl Group>

A solution of a compound having a phenolic hydroxyl group was prepared in the same manner as in preparation of the solution of a compound having a phenolic hydroxyl group in STEP 1 in preparation of coating liquid E1 except that the amount of poly(vinylphenol) was changed to 1.00 g.

<Preparation of Solution of Metal Alkoxide>

The amounts of titanium isopropoxide and the solvent used in preparation of the solution of titanium isopropoxide in ethanol in STEP 1 in preparation of coating liquid E1 were varied as shown in Table 7. Except for these, a solution of a metal alkoxide was prepared in the same manner as in preparation of the solution of a metal alkoxide in preparation of coating liquid E1.

<Preparation of Solution of Compound for Ligand>

Guaiacol and ethanol in amounts shown in Table 7 were placed in a 100 mL glass container, and were stirred to prepare a solution of guaiacol in ethanol.

<Preparation of Solution of Metal Complex>

The solution of a metal alkoxide and the solution of a compound for a ligand were mixed to prepare a solution of a metal complex.

Step 2

Coating liquids E11 to 20 were prepared in the same manner as in coating liquid E1 except that the solution of a compound having a phenolic hydroxyl group and the solution of a metal complex prepared above were mixed in amounts shown in "STEP 2" in Table 7.

[Coating Liquid C13]

<Preparation of Solution of Metal Alkoxide>

Ethanol (15.0 g) and titanium isopropoxide (0.46 g) were weighed, were placed in a 100 mL glass container, and were stirred to prepare a solution of titanium isopropoxide in ethanol.

<Preparation of Solution of Compound for Ligand>

Guaiacol (0.41 g) and ethanol (34.2 g) were placed in a 100 mL glass container, and were stirred to prepare a solution of guaiacol in ethanol.

<Preparation of Solution of Metal Complex>

The solution of titanium isopropoxide in ethanol and the solution of guaiacol in ethanol prepared above were mixed, and were stirred to prepare a solution of a metal complex as coating liquid C13.

[Coating Liquid E21]

(Step 1)

<Preparation of Solution of Compound Having Phenolic Hydroxyl Group>

Methyl isobutyl ketone (99.0 g) and poly(vinylphenol) (1.00 g) were placed in a 100 mL glass container, and were stirred to prepare a solution of poly(vinylphenol) in methyl isobutyl ketone.

<Preparation of Solution of Metal Alkoxide>

Ethanol (15.1 g) and titanium isopropoxide (0.39 g) were placed in a 100 mL glass container, and were stirred to prepare a solution of titanium isopropoxide in ethanol.

<Preparation of Aqueous Solution of Compound for Ligand> o-Anisic acid (0.42 g), ethanol (34.1 g) and ion-exchanged water (0.049 g) were placed in a 100 mL container, and were stirred to prepare an aqueous solution of o-anisic acid in ethanol.

<Preparation of Solution of Metal Complex>

The solution of a metal alkoxide and the aqueous solution of a compound for a ligand were mixed to prepare an aqueous solution of a metal complex having a titanium atom coordinated with o-anisic acid.

(Step 2)

<Preparation of Coating Liquid>

The solution (35.0 g) of poly(vinylphenol) in methyl isobutyl ketone and the aqueous solution (15.0 g) of a metal complex prepared above were placed in a 100 mL glass container, and were stirred to prepare coating liquid E21.

[Coating Liquid E22]

(Step 1)

<Preparation of Solution of Compound Having Phenolic Hydroxyl Group>

Methyl isobutyl ketone (99.1 g) and poly(vinylphenol) (1.01 g) were placed in a 100 mL glass container, and were stirred to prepare a solution of poly(vinylphenol) in methyl isobutyl ketone.

<Preparation of Solution of Metal Alkoxide>

Ethanol (15.0 g) and titanium isopropoxide (0.35 g) were placed in a 100 mL glass container, and were stirred to prepare a solution of titanium isopropoxide in ethanol.

<Preparation of Aqueous Solution of Compound for Ligand>

Quinaldic acid (0.43 g), ethanol (34.2 g) and ion-exchanged water (0.044 g) were placed in a 100 mL container, and were stirred to prepare a solution of quinaldic acid in ethanol.

<Preparation of Solution of Metal Complex>

The aqueous solution of a compound for a ligand was added to the solution of a metal alkoxide, and was stirred to prepare an aqueous solution of a metal complex.

(Step 2)

<Preparation of Coating Liquid>

The solution (35.0 g) of poly(vinylphenol) in methyl isobutyl ketone and the aqueous solution (15.0 g) of a metal complex were placed in a 100 mL glass container, and were stirred to prepare coating liquid E22.

[Coating Liquid E23]

(Step 1)

<Preparation of Solution of Compound Having Phenolic Hydroxyl Group>

Methyl isobutyl ketone (99.1 g) and poly(vinylphenol) (1.00 g) were placed in a 100 mL glass container, and were stirred to prepare a solution of poly(vinylphenol) in methyl isobutyl ketone.

<Preparation of Solution of Metal Alkoxide>

Ethanol (15.0 g) and titanium isopropoxide (0.39 g) were placed in a 100 mL glass container, and were stirred to prepare a solution of titanium isopropoxide in ethanol.

<Preparation of Solution of Compound for Ligand>

2-Acetylpyrrole (0.42 g) and ethanol (34.1 g) were placed in a 100 mL glass container, and were stirred to prepare a solution of 2-acetylpyrrole in ethanol.

<Preparation of Solution of Metal Complex>

The solution of 2-acetylpyrrole in ethanol was added to the solution of a metal alkoxide, and was mixed with stirring to prepare a solution of a metal complex.

(Step 2)

<Preparation of Coating Liquid>

The solution (35.0 g) of poly(vinylphenol) in methyl isobutyl ketone and the solution (15.0 g) of a metal complex were placed in a 100 mL glass container, and were stirred to prepare coating liquid E23.

[Coating Liquid E24]

(Step 1)

<Preparation of Solution of Compound Having Phenolic Hydroxyl Group>

Methyl isobutyl ketone (99.0 g) and poly(vinylphenol) (1.00 g) were placed in a 100 mL glass container, and were stirred to prepare a solution of poly(vinylphenol) in methyl isobutyl ketone.

<Preparation of Solution of Metal Alkoxide>

Ethanol (15.1 g) and titanium isopropoxide (0.53 g) were placed in a 100 mL glass container, and were stirred to prepare a solution of titanium isopropoxide in ethanol.

<Preparation of Solution of Compound for Ligand>

N,N-Dimethylglycine (0.39 g) and ethanol (34.1 g) were placed in a 100 mL glass container, and were stirred to prepare a solution of N,N-dimethylglycine in ethanol.

<Preparation of Solution of Metal Complex>

The solution of a compound for a ligand was added to the solution of a metal alkoxide, and was mixed with stirring to prepare a solution of a metal complex.

(Step 2)

<Preparation of Coating Liquid>

The solution (35.0 g) of poly(vinylphenol) in methyl isobutyl ketone and the solution (15.0 g) of a metal complex were placed in a 100 mL glass container, and were stirred to prepare coating liquid E24.

[Coating Liquid E25]

(Step 1)

<Preparation of Solution of Compound Having Phenolic Hydroxyl Group>

Methyl isobutyl ketone (99.1 g) and poly(vinylphenol) (1.01 g) were weighed, were placed in a 100 mL glass container, and were stirred to prepare a solution of poly (vinylphenol) in methyl isobutyl ketone.

<Preparation of Solution of Metal Complex>

Ethanol (50.0 g) and pentamethylcyclopentadienyltitanium trimethoxide (0.39 g) were weighed, were placed in a 100 mL glass container, and were stirred to prepare a solution of pentamethylcyclopentadienyltitanium trimethoxide in ethanol. Pentamethylcyclopentadienyltitanium trimethoxide is a compound having a titanium atom coordinated with a pentamethylcyclopentadienyl group. Accordingly, the solution prepared in this step is a solution of a metal alkoxide and a solution of a metal complex.

(Step 2)

<Preparation of Coating Liquid>

The solution (45.0 g) of poly(vinylphenol) in methyl isobutyl ketone and the solution (5.0 g) of pentamethylcyclopentadienyltitanium trimethoxide in ethanol prepared above were placed in a 100 mL glass container, and were stirred to prepare coating liquid E25.

The formulae of coating liquids E1 to E25 are shown in Table 7. The summary of the formulae of coating liquids C1 to C13 is shown in Table 8.

TABLE 7

| | STEP1 | | | | | | | | | | | | | | STEP2 | |
|---|---|---|---|---|---|---|---|---|---|---|---|---|---|---|---|---|
| | Solution of compound having phenolic hydroxyl group, (1) | | | | Solution of metal complex, (2) | | | | | | | | | | | |
| Coating liquid No. | Compound having phenolic hydroxyl group, (A) | | Solvent for A | | Metal alkoxide M | | Solvent for M | | Compound for ligand, L | | Solvent for L | | Others | | (1) | (2) |
| E1 | P1 | 1.01 g | S3 | 99.0 g | MA1 | 0.39 g | S2 | 15.1 g | L1 | 0.42 g | S2 | 34.2 g | — | — | 35.0 g | 15.0 g |
| E2 | P1 | 0.45 g | S4 | 44.6 g | MA1 | 1.78 g | S1 | 48.3 g | — | — | — | — | — | — | 45.0 g | 5.0 g |
| E3 | P1 | 1.00 g | S3 | 99.0 g | MA2 | 1.78 g | S6 | 48.3 g | (Acetylacetone) | — | — | — | — | — | 45.0 g | 5.0 g |
| E4 | P1 | 1.00 g | S3 | 99.0 g | MA2 | 1.78 g | S6 | 48.3 g | (Acetylacetone) | — | — | — | — | — | 35.0 g | 15.0 g |
| E5 | P1 | 1.00 g | S3 | 99.0 g | MA2 | 1.78 g | S6 | 48.3 g | (Acetylacetone) | — | — | — | — | — | 25.0 g | 25.0 g |
| E6 | P1 | 1.00 g | S3 | 99.0 g | MA2 | 1.78 g | S6 | 48.3 g | (Acetylacetone) | — | — | — | — | — | 15.0 g | 35.0 g |
| E7 | P2 | 1.02 g | S3 | 99.1 g | MA1 | 0.39 g | S2 | 15.0 g | L1 | 0.42 g | S2 | 34.2 g | — | — | 35.0 g | 15.0 g |
| E8 | P3 | 1.01 g | S3 | 99.0 g | MA1 | 0.39 g | S2 | 15.0 g | L1 | 0.42 g | S2 | 34.2 g | — | — | 35.0 g | 15.0 g |
| E9 | P4 | 1.02 g | S3 | 99.0 g | MA1 | 0.39 g | S2 | 15.0 g | L1 | 0.42 g | S2 | 34.2 g | — | — | 35.0 g | 15.0 g |
| E10 | P5 | 1.00 g | S3 | 99.1 g | MA1 | 0.39 g | S2 | 15.0 g | L1 | 0.42 g | S2 | 34.3 g | — | — | 35.0 g | 15.1 g |
| E11 | P6 | 1.01 g | S3 | 99.0 g | MA1 | 0.39 g | S2 | 15.0 g | L1 | 0.42 g | S2 | 34.3 g | — | — | 35.1 g | 15.0 g |
| E12 | P1 | 0.45 g | S1 | 44.6 g | MA3 | 0.74 g | S1 | 49.3 g | (Acetylacetone) | — | — | — | — | — | 35.0 g | 15.0 g |
| E13 | P1 | 0.44 g | S1 | 44.5 g | MA4 | 1.34 g | S1 | 48.6 g | (Acetoacetate ester) | — | — | — | — | — | 35.0 g | 15.0 g |
| E14 | P1 | 1.00 g | S3 | 99.0 g | MA1 | 0.64 g | S2 | 15.1 g | L1 | 0.35 g | S2 | 34.0 g | — | — | 35.0 g | 15.0 g |

TABLE 7-continued

| Coating liquid No. | STEP1: Solution of compound having phenolic hydroxyl group, (1): Compound having phenolic hydroxyl group, (A) | | Solvent for A | | Solution of metal complex, (2): Metal alkoxide M | | Solvent for M | | Compound for ligand, L | | Solvent for L | | Others | | STEP2 (1) | STEP2 (2) |
|---|---|---|---|---|---|---|---|---|---|---|---|---|---|---|---|---|
| E15 | P1 | 1.00 g | S3 | 99.0 g | MA1 | 0.39 g | S2 | 15.0 g | L1 | 0.42 g | S2 | 34.2 g | — | — | 35.0 g | 15.0 g |
| E16 | P1 | 1.00 g | S3 | 99.0 g | MA1 | 0.28 g | S2 | 15.0 g | L1 | 0.46 g | S2 | 34.3 g | — | — | 35.0 g | 15.0 g |
| E17 | P1 | 1.00 g | S3 | 99.0 g | MA1 | 0.46 g | S2 | 15.0 g | L2 | 0.41 g | S2 | 34.1 g | — | — | 45.0 g | 5.0 g |
| E18 | P1 | 1.00 g | S3 | 99.0 g | MA1 | 0.46 g | S2 | 15.1 g | L2 | 0.41 g | S2 | 34.1 g | — | — | 35.0 g | 15.0 g |
| E19 | P1 | 1.00 g | S3 | 99.0 g | MA1 | 0.46 g | S2 | 15.0 g | L2 | 0.41 g | S2 | 34.2 g | — | — | 25.0 g | 25.0 g |
| E20 | P1 | 1.00 g | S3 | 99.0 g | MA1 | 0.46 g | S2 | 15.0 g | L2 | 0.41 g | S2 | 34.1 g | — | — | 15.0 g | 35.0 g |
| E21 | P1 | 1.00 g | S3 | 99.0 g | MA1 | 0.39 g | S2 | 15.1 g | L1 | 0.42 g | S2 | 34.1 g | S5 | 0.049 g | 35.0 g | 15.0 g |
| E22 | P1 | 1.01 g | S3 | 99.1 g | MA1 | 0.35 g | S2 | 15.0 g | L3 | 0.43 g | S2 | 34.2 g | S5 | 0.044 g | 35.0 g | 15.0 g |
| E23 | P1 | 1.00 g | S3 | 99.1 g | MA1 | 0.39 g | S2 | 15.0 g | L4 | 0.42 g | S2 | 34.1 g | — | — | 35.0 g | 15.0 g |
| E24 | P1 | 1.00 g | S3 | 99.0 g | MA1 | 0.53 g | S2 | 15.1 g | L5 | 0.39 g | S2 | 34.1 g | — | — | 35.0 g | 15.0 g |
| E25 | P1 | 1.01 g | S3 | 99.1 g | MA5 | 0.39 g | S2 | 50.0 g | (Pentamethylcyclopentadienyl) | — | — | — | — | — | 45.0 g | 5.0 g |

TABLE 8

| Coating liquid No. | STEP 1: Solution of compound having phenolic hydroxyl group ( 1): Compound having phenolic hydroxyl group, A | | Solvent for A | | Solution of metal complex, (2): Metal alkoxide M | | Solvent for M | | Compound for ligand, L | | Solvent for L | | Others | | STEP2 (1) | STEP2 (2) |
|---|---|---|---|---|---|---|---|---|---|---|---|---|---|---|---|---|
| C1 | P1 | 1.01 g | S3 | 99.0 g | — | — | — | — | — | — | — | — | — | — | — | — |
| C2 | — | — | — | — | MA1 | 0.39 g | S2 | 15.1 g | L1 | 0.42 g | S2 | 34.2 g | — | — | — | — |
| C3 | — | — | — | — | MA1 | 1.78 g | S1 | 48.3 g | — | — | — | — | — | — | — | — |
| C4 | P1 | 0.45 g | S4 | 44.6 g | — | — | — | — | — | — | — | — | MO1 | 0.051 g | — | — |
| C5 | — | — | — | — | MA2 | 1.78 g | S6 | 48.3 g | — | — | — | — | — | — | — | — |
| C6 | P2 | 1.02 g | S3 | 99.1 g | — | — | — | — | — | — | — | — | — | — | — | — |
| C7 | P3 | 1.01 g | S3 | 99.0 g | — | — | — | — | — | — | — | — | — | — | — | — |
| C8 | P4 | 1.02 g | S3 | 99.0 g | — | — | — | — | — | — | — | — | — | — | — | — |
| C9 | P5 | 1.00 g | S3 | 99.0 g | — | — | — | — | — | — | — | — | — | — | — | — |
| C10 | P6 | 1.01 g | S3 | 99.1 g | — | — | — | — | — | — | — | — | — | — | — | — |
| C11 | — | — | — | — | MA3 | 0.73 g | S1 | 49.3 g | — | — | — | — | — | — | — | — |
| C12 | — | — | — | — | MA4 | 1.33 g | S1 | 48.6 g | — | — | — | — | — | — | — | — |
| C13 | — | — | — | — | MA1 | 0.46 g | S2 | 15.0 g | L2 | 0.41 g | S2 | 34.2 g | — | — | — | — |

[Structural Analysis of Polymetalloxane]

The structures of the polymetalloxanes formed of the coating liquids were analyzed by the following methods.

(1) Presence of a bond between the phenolic hydroxyl group in the polymer and the metal atom of the metalloxane: solid NMR (2) Presence of the metalloxane bond in the polymetalloxane: solid NMR (3) Presence of the metal atom in the polymetalloxane: EDAX (4) Presence of a ligand coordinated with the metal atom in the metalloxane structure: solid NMR (5) Analysis of the crystal structure of the polymetalloxane: XRD Hereinafter, the methods of analysis will be described in detail.

(1) Solid NMR Analysis

Coating liquid E2 and coating liquid C4 were each dropped onto an aluminum sheet degreased with ethanol. The sheets were then rotated at 300 rpm for 2 seconds to form coatings. The coatings were dried under an environment at normal temperature and normal humidity (temperature: 23° C., relative humidity: 50%) for 60 minutes. The sheets were placed in a hot air circulating drying furnace, and were dried at a temperature of 80° C. for 60 minutes. The resulting coatings were peeled from the sheets, and were ground to prepare samples for measurement.

These samples were measured with a nuclear magnetic resonance apparatus (trade name: NMR spectrometer ECX 500 II; manufactured by JOEL RESONANCE Inc.) by solid NMR ($^{13}$C-CPMAS method) to perform NMR analysis. The measurement was performed using a sample tube having an outer diameter of 3.2 mm at an MAS rate of 15 kHz and the integrated number of rotations of 256.

Figure 4:
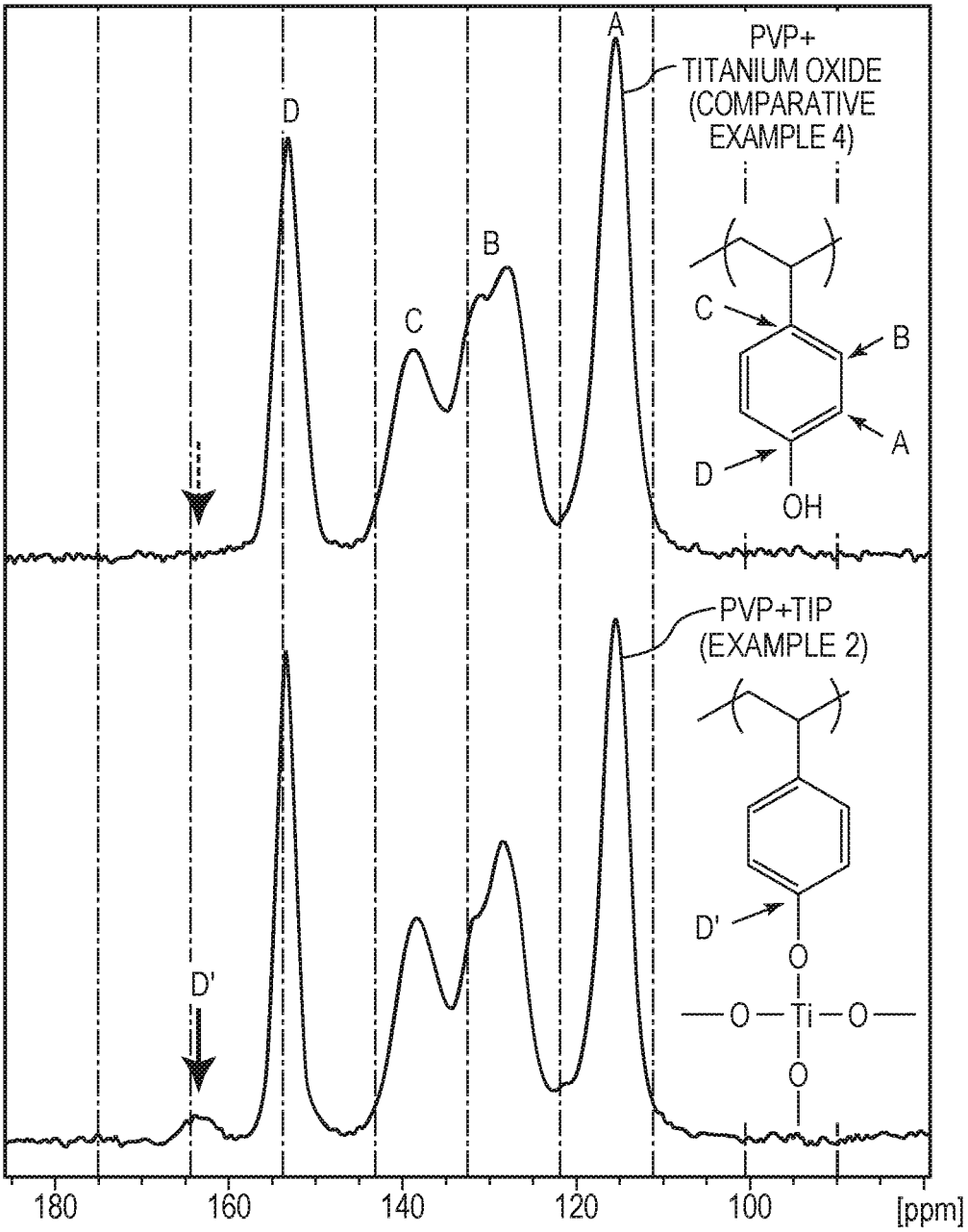
FIG. 4 is the results of solid NMR analysis of an exemplary surface layer according to the present invention (Example 2) and an comparative example (Comparative Example 4).

The results of measurement are shown in FIG. 4. In FIG. 4, the spectrum of Example 2 represents coating liquid E2, and the spectrum of Comparative Example 4 represents coating liquid C4. The polymetalloxane surface layer prepared with coating liquid E2 had a peak D', which was not present in the starting materials. It is inferred that this is because the peak D of the carbon atom bonded to the hydroxyl group in poly(vinylphenol) was shifted as a result of the reaction between the hydroxyl group and titanium isopropoxide. Accordingly, it was verified that poly(vinylphenol) reacted with titanium isopropoxide.

The structures of coating liquids E1 and E3 to E25 were analyzed in the same manner as above. As a result, it was verified that the phenolic hydroxyl group reacted with the metal atom in the polymetalloxane.

(2) NMR Analysis (Verification of Metalloxane Bond in Compound Contained in Coating Liquid, Such as Presence of Ti—O—Ti Bond)

$^{17}O$ was introduced into coating liquid E2 with oxygen 17-labeled water (50 atom %), and coating liquid E2 was measured with a nuclear magnetic resonance apparatus (trade name: AVANCE 500 NMR; manufactured by Bruker Corporation) to measure the NMR of the solution $^{17}O$ and perform NMR analysis.

As a result, peaks were detected at 300 to 800 ppm in the $^{17}C$ NMR spectrum, and the presence of Ti—O—Ti bonds was verified.

(3) Verification of Presence of Metal Atom in Coating Prepared with Coating Liquid.

Samples prepared in the same manner as in (1) were observed with a scanning electron microscope (SEM) (trade name: S-3700N; manufactured by Hitachi High-Technologies Corporation), and element analysis was performed with an energy dispersive X-ray analyzer (trade name: Xflash 6/30; manufactured by Bruker Corporation). The element analysis was performed in the viewing field at an applied voltage of 20 kV, a current of a probe of 80 mA, and a magnification of ×300.

As a result, K-alpha ray peaks derived from the Ti atom appeared at about 4.5 keV, and the presence of the Ti atoms was verified.

(4) Verification of Ligand Coordinated with Metal in Coatings Prepared with Coating Liquids E1 and E3 to E25.

In the preparation of the sample for solid NMR analysis described in the above (1), the coating solution E2 was changed to the coating solution E1. For the rest, sample was prepared in the same manner as the sample preparation method described in the above (1). The samples were measured with a nuclear magnetic resonance apparatus (trade name: AVANCE III 500 NMR; manufactured by Bruker Corporation) by solid NMR ($^{13}C$-CPMAS method) to perform NMR analysis. The measurement was performed using a sample tube having an outer diameter of 3.2 mm at an MAS rate of 15 kHz and the integrated number of rotations of 256.

As a result, it was verified that the peak (attributed to the carbon atom bonded to the methoxy group of o-anisic acid) detected at 160 ppm in the $^{13}C$ NMR spectrum was shifted to a lower magnetic field, and o-anisic acid was coordinated with Ti.

In addition, regarding the coating liquids E3 to E25, samples were prepared in the same manner as the above, and analyzed. As a result, in each of samples, it was verified that ligand was coordinated with metal.

(5) Analysis of Crystal Structure by XRD

Coating liquid E2 and coating liquid C4 were each dropped onto an aluminum sheet degreased with ethanol. The sheets were then rotated at 300 rpm for 2 seconds to form coatings. The coatings were dried under an environment at normal temperature and normal humidity (temperature: 23° C., relative humidity: 50%) for 60 minutes. The sheets were placed in a hot air circulating drying furnace, and were dried at a temperature of 80° C. for 60 minutes. The resulting coatings were peeled from the sheets, and were ground to prepare samples for measurement.

The samples were disposed in an aluminum sample holder such that the surfaces to be measured were smoothly aligned. The samples were 2θ/θ scanned with an X-ray diffraction apparatus (trade name: RINT-TTR II; manufactured by Rigaku Corporation), and were measured at 2θ=3 to 60°. The X-ray diffraction measurement was performed by a parallel beam method at an X-ray output of 50 kV using a CuKα-ray of 300 mA and a vertical diffusion restricting slit of 10.0 mm.

Figure 5A:
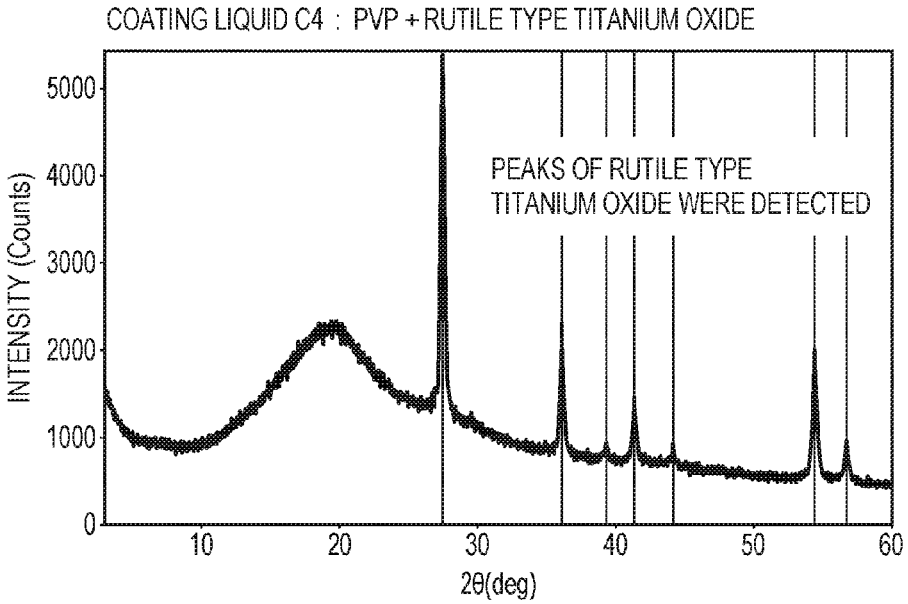
FIG. 5A is the result of analysis of the crystal structure in which the peak of rutile type titanium oxide is detected (Comparative Example 4).
Figure 5B:
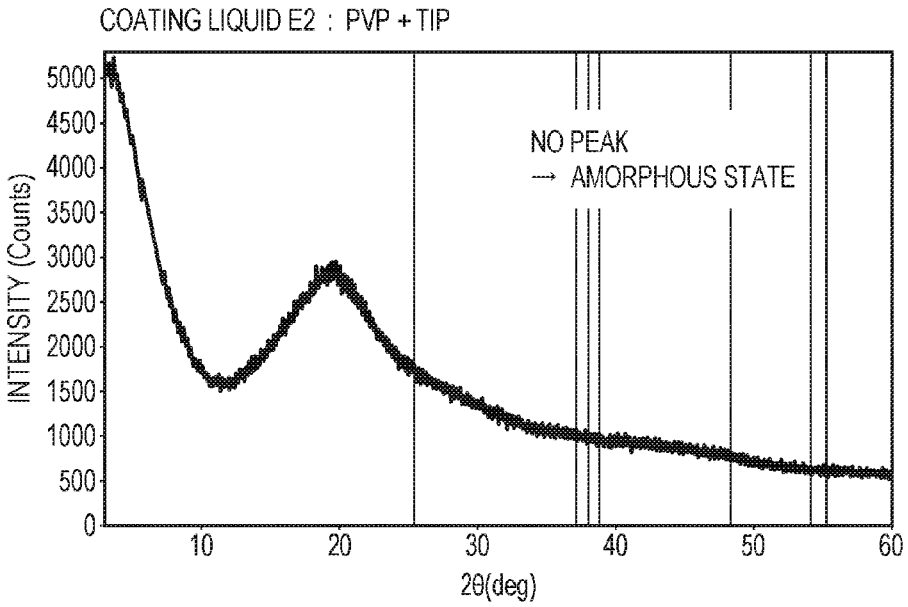
FIG. 5B is the result of analysis of the crystal structure of an exemplary surface layer according to the present invention (Example 2).

The results of measurement are shown in FIG. 5A and FIG. 5B. The peaks derived from titanium oxide having a rutile type crystal structure were observed in the surface layer formed of coating liquid C4 (Comparative Example 4). In contrast, no peak derived from the crystal structure was present in the surface layer formed of coating liquid E2 (Example 2), and therefore it was verified that the surface layer was in an amorphous state.

Samples prepared with coating liquids E1 and E3 to E25 were subjected to crystal structure analysis in the same manner as above. As a result, no peak derived from the crystal structure was observed in all of the samples, and it was verified that these were in an amorphous state.

Example 1

[Preparation of Electro-Conductive Elastic Roller 1]

The materials shown in Table 9 were mixed in a 6 L pressurized kneader (trade name: TD6-15MDX, manufactured by Toshin Co., Ltd.) at a filling rate of 70% by volume and a number of rotation of the blade of 30 rpm for 24 minutes to prepare an unvulcanized rubber composition. Tetrabenzylthiuram disulfide [trade name: Sanceler TBzTD, manufactured by Sanshin Chemical Industry Co., Ltd.] (4.5 parts) as a vulcanization accelerator and sulfur (1.2 parts) as a vulcanizing agent were added to the unvulcanized rubber composition (174 parts by mass). These materials were horizontally turned 20 times in total with open rolls each having a roll diameter of 12 inches at a number of rotations of the forward roll of 8 rpm, a number of rotations of the back roll of 10 rpm, and an interval of the rolls of 2 mm. Subsequently, tight milling was performed 10 times at an interval of the rolls of 0.5 mm to prepare "Kneaded product 1" for an electro-conductive elastic layer.

TABLE 9

| Raw materials | Amount used (parts by mass) |
|---|---|
| Medium-high nitrile NBR (Trade name: Nipol DN219, manufactured by ZEON Corporation) | 100 |
| Coloring grade carbon black (Trade name: #7360, manufactured by Tokai Carbon Co., Ltd.) | 48 |
| Calcium carbonate (Trade name: NANOX #30, manufactured by Maruo Calcium Co., Ltd.) | 20 |
| Zinc oxide (Trade name: Two zinc oxides; manufactured by Sakai Chemical Industry Co., Ltd.) | 5 |
| Stearic acid (Trade name: Zinc stearate; manufactured by NOF CORPORATION) | 1 |

Next, a cylindrical support made of steel and having a diameter of 6 mm and a length of 252 mm (having a nickel-placed surface. Hereinafter, referred to as "core metal") was prepared. A thermosetting adhesive containing a metal and rubber (trade name: METALOC U-20, manufactured by Toyokagaku Kenkyusho Co., Ltd.) was applied onto a region of the core metal in width of 115.5 mm ranging from the center in the axis direction toward each end of the core metal (the region having a total width of 231 mm in the axis direction). This core metal was dried at a temperature of 80° C. for 30 minutes, and further at 120° C. for 1 hour to form an adhesive layer.

By extrusion molding using a crosshead, Kneaded product 1 was simultaneously extruded coaxially with the core, i.e., the core metal with the adhesive layer into a cylindrical shape having an outer diameter of 8.75 to 8.90 mm. Both ends were cut off to prepare a roller including the core metal and the unvulcanized electro-conductive elastic layer disposed on the outer periphery of the core metal. The extruder used had a cylinder diameter of 70 mm and L/D=20. The temperatures of the head, the cylinder and the screw during extrusion were adjusted to 90° C.

Next, the roller was vulcanized in a continuous heating furnace provided with two zones having different temperatures. The roller was passed through the first zone set at a temperature of 80° C. in 30 minutes, and was passed through the second zone set at a temperature of 160° C. for 30 minutes to prepare Electro-conductive elastic roller 1.

Next, both ends of the electro-conductive elastic layer portion (rubber portion) of Electro-conductive elastic roller 1 were cut off to prepare an electro-conductive elastic layer having a width in the axis direction of 232 mm. Subsequently, the surface of the electro-conductive elastic layer was polished with a rotary grinding wheel (the number of rotations of the work: 333 rpm, the number of rotations of the grinding wheel: 2080 rpm, polishing time: 12 sec). Electro-conductive elastic roller 1 was thereby prepared. Electro-conductive elastic roller 1 had a crown shape having an end diameter of 8.26 mm and a central diameter of 8.50 mm, a surface ten-point height of irregularities Rz of 5.5 μm, a runout of 18 μm, and a hardness of 73° (Asker C).

The ten-point height of irregularities Rzj is was determined according to JIS B 0601:2013. The runout was determined with a high precision laser analyzer LSM 430v manufactured by Mitutoyo Corporation. Specifically, the outer diameter of the roller was measured with the analyzer to determine an outer diameter difference runout from the largest outer diameter and the smallest outer diameter. Five points of the roller were subjected to this measurement. The average of the five outer diameter difference runouts was defined as the runout of the target roller. The Asker C hardness was measured as follows: a probe of Asker Type C Durometer (manufactured by Kobunshi Keiki Co., Ltd.) was brought into contact with the surface of the target roller under a pressure of 1000 g under an environment at 25° C. and 55% RH.

[Formation of Surface Layer]

Electro-conductive elastic roller 1 was ring coated with coating liquid E1 at an output rate of 0.120 ml/s (speed of the ring area: 85 mm/s). The roller was left at normal temperature and normal pressure to be dried. The roller was then irradiated with ultraviolet light at a wavelength of 254 nm in an accumulated amount of light of 9000 mJ/cm$^2$ to form a surface layer. The roller was irradiated with ultraviolet light from a low pressure mercury lamp [manufactured by Harison Toshiba Lighting Corporation (new company name: TOSHIBA LIGHTING & TECHNOLOGY CORPORATION)]. Charging member E1 was thereby prepared.

[Evaluation of Abnormal Discharge]

The charging roller mounted on a cyan cartridge for a laser printer (trade name: HP Color Laser Jet CP4525, manufactured by Hewlett-Packard Company) was replaced with charging member E1 prepared above. This cartridge was set on a laser printer (trade name: HP Color Laser Jet CP4525, manufactured by Hewlett-Packard Company, thickness of the charge transport layer of the photosensitive member: 21 μm), and a halftone image was formed on A4 size paper. An electrophotographic image was formed without pre-exposure. The charge voltage was set at −1141 V, and the transfer voltage was set at 2575 V. These settings produce an environment more readily generating abnormal discharge. The electrophotographic image was output under an environment at low temperature and low humidity (temperature: 15° C., humidity: 10%).

The unevenness of the halftone image attributed to abnormal discharge was visually observed to evaluate whether abnormal discharge occurred or not. The results are shown in Table 10.

In Table 10, ROR=1 represents addition of a molar amount of ion-exchanged water equivalent to the alkoxyl groups bonded to the metal atom after formation of the complex.

In Table 10, "M/L" represents the ratio of the molar amount (L) of the ligand to the molar amount (M) of the metal atom in the polymetalloxane forming the surface layer of the charging roller. Accordingly, it is shown that two ligands are coordinated with one Ti atom in the polymetalloxane forming the surface layer of charging member E1.

A: No abnormal discharge

B: Generation of abnormal discharge

Examples 2 to 25 and Comparative Examples 1 to 13

Charging members E2 to E25 and charging members C1 to C13 were prepared in the same manner as in Example 1 except that coating liquids E2 to E25 and coating liquids C1 to C13 were used. Charging members E2 to E25 and charging members C1 to C13 were evaluated. The results of evaluation are collectively shown in Table 10.

TABLE 10

| | Charging member No. | Polymer having phenolic hydroxyl group, (A) | Metal (M) | Ligand (L) | M/L | ROR | Evaluation |
|---|---|---|---|---|---|---|---|
| Example 1 | E1 | P1 | Titanium | o-Anisic acid | 1/2 | — | A |
| Comparative Example 1 | C1 | P1 | — | — | — | — | B |
| Comparative Example 2 | C2 | — | Titanium | o-Anisic acid | 1/2 | — | B |
| Example 2 | E2 | P1 | Titanium | — | — | — | A |
| Comparative Example 3 | C3 | — | Titanium | — | — | — | B |

TABLE 10-continued

| | Charging member No. | Polymer having phenolic hydroxyl group, (A) | Metal (M) | Ligand (L) | M/L | ROR | Evaluation |
|---|---|---|---|---|---|---|---|
| Comparative Example 4 | C4 | P1 | Titanium oxide* | — | — | — | B |
| Example 3 | E3 | P1 | Titanium | Acetylacetone | 1/2 | — | A |
| Example 4 | E4 | P1 | Titanium | Acetylacetone | 1/2 | — | A |
| Example 5 | E5 | P1 | Titanium | Acetylacetone | 1/2 | — | A |
| Example 6 | E6 | P1 | Titanium | Acetylacetone | 1/2 | — | A |
| Comparative Example 5 | C5 | — | Titanium | Acetylacetone | 1/2 | — | B |
| Example 7 | E7 | P2 | Titanium | o-Anisic acid | 1/2 | — | A |
| Example 8 | E8 | P3 | Titanium | o-Anisic acid | 1/2 | — | A |
| Example 9 | E9 | P4 | Titanium | o-Anisic acid | 1/2 | — | A |
| Comparative Example 6 | C6 | P2 | — | — | — | — | B |
| Comparative Example 7 | C7 | P3 | — | — | — | — | B |
| Comparative Example 8 | C8 | P4 | — | — | — | — | B |
| Example 10 | E10 | P5 | Titanium | o-Anisic acid | 1/2 | — | A |
| Example 11 | E11 | P6 | Titanium | o-Anisic acid | 1/2 | — | A |
| Comparative Example 9 | C9 | P5 | — | — | — | — | B |
| Comparative Example 10 | C10 | P6 | — | — | — | — | B |
| Example 12 | E12 | P1 | Tantalum | Acetylacetone | 1/1 | — | A |
| Example 13 | E13 | P1 | Aluminum | Acetoacetate ester | 1/1 | — | A |
| Comparative Example 11 | C11 | — | Tantalum | Acetylacetone | 1/1 | — | B |
| Comparative Example 12 | C12 | — | Aluminum | Acetoacetate ester | 1/1 | — | B |
| Example 14 | E14 | P1 | Titanium | o-Anisic acid | 1/1 | — | A |
| Example 15 | E15 | P1 | Titanium | o-Anisic acid | 1/2 | — | A |
| Example 16 | E16 | P1 | Titanium | o-Anisic acid | 1/3 | — | A |
| Example 17 | E17 | P1 | Titanium | Guaiacol | 1/2 | — | A |
| Example 18 | E18 | P1 | Titanium | Guaiacol | 1/2 | — | A |
| Example 19 | E19 | P1 | Titanium | Guaiacol | 1/2 | — | A |
| Example 20 | E20 | P1 | Titanium | Guaiacol | 1/2 | — | A |
| Comparative Example 13 | C13 | — | Titanium | Guaiacol | 1/2 | — | B |
| Example 21 | E21 | P1 | Titanium | o-Anisic acid | 1/2 | 1 | A |
| Example 22 | E22 | P1 | Titanium | Quinaldic acid | 1/2 | 1 | A |
| Example 23 | E23 | P1 | Titanium | 2-Acetylpyrrole | 1/2 | — | A |
| Example 24 | E24 | P1 | Titanium | N,N-Dimethylglycine | 1/2 | — | A |
| Example 25 | E25 | P1 | Titanium | Pentamethylcyclopentadienyl | 1/1 | — | A |

*Present in the surface layer as a titanium oxide particle

Examples 26 and 27 and Comparative Example 14 o-Anisic acid and quinaldic acid as a compound for a ligand have strong affinity with electrons; hence, it is believed that polymers formed with these compounds have particularly shallow HOMOs. To evaluate the charging members prepared with these compounds for a ligand under a severe condition in which abnormal discharge was more readily generated, evaluation of abnormal discharge was performed in these Examples using a photosensitive member including a charge transport layer having an increased thickness (27.5 μm).

Charging member E1 (Example 26) formed with o-anisic acid, charging member E22 (Example 27) formed with quinaldic acid as a compound for a ligand, and charging member C1 (Comparative Example 14) were evaluated. An electrophotographic image was formed without pre-exposure. The charge voltage was set at −1141 V, and the transfer voltage was set at 1856 V. Except for these, generation of abnormal discharge was evaluated in the same manner as in Example 1.

The results are shown in Table 11. While abnormal discharge was generated in charging member C1, no abnormal discharge was observed in charging member E1 and charging member E22.

TABLE 11

| | Charging member No. | Polymer having phenolic hydroxyl group, (A) | Metal (M) | Ligand (L) | M/L | ROR | Evaluation |
|---|---|---|---|---|---|---|---|
| Example 26 | E1 | Poly(vinylphenol) | Titanium | o-Anisic acid | 1/2 | — | A |
| Example 27 | E22 | Poly(vinylphenol) | Titanium | Quinaldic acid | 1/2 | 1 | A |

TABLE 11-continued

| | Charging member No. | Polymer having phenolic hydroxyl group, (A) | Metal (M) | Ligand (L) | M/L | ROR | Evaluation |
|---|---|---|---|---|---|---|---|
| Comparative Example 14 | C1 | Poly(vinylphenol) | — | — | — | — | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-081145, filed Apr. 10, 2015, which is hereby incorporated by reference herein in its entirety.

What is claimed is:

1. A charging member comprising:

a support; and a surface layer, wherein the surface layer comprises a polymetalloxane having a structure represented by Structural Formula (a1); and M1 in the polymetalloxane and a carbon atom in a structural unit represented by Structural Formula (a2) are bonded with a linking group represented by Structural Formula (a3):

Structural Formula (a1)

$$M1O_{(k-(s+1))/2}(L1)_s$$

Structural Formula (a2)

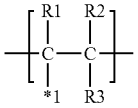

Structural Formula (a3)

where in Formula (a1),

M1 represents a metal atom selected from the group consisting of Ti, Zr, Hf, V, Nb, Ta, W, Al, Ga, In and Ge;

s represents an integer of 0 or more and (k−2) or less;

in the case that M1 is Al, Ga or In, then k=3;

in the case that M1 is Ti, Zr, Hf or Ge, then k=4;

in the case that M1 is Nb, Ta or W, then k=5;

in the case that M1 is V, then k=3 or 5; and

L1 represents a ligand having a structure represented by Formula (b) or a ligand having a structure represented by Formula (c):

(b)

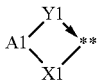

where in Formula (b),

X1 represents a structure represented by one of Formulae (1) to (4);

Y1 represents a group having a site of coordination with M1;

A1 represents a bond or an atomic group needed to form a 4- to 8-membered ring with M1, X1 and Y1; and a symbol "**" represents a site of bonding to or coordination with M1:

(1)

(2)

(3)

(4)

where in Formulae (1) to (4), a symbol "" represents a site of bonding to M1; and a symbol "*" represents a site of bonding to A1;

(c)

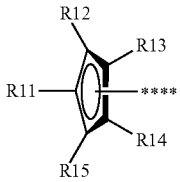

where in Formula (c),

R11 to R15 each independently represent a hydrogen atom, an alkyl group having 1 to 4 carbon atoms, or a trimethylsilyl group; and a symbol "****" represents a site of coordination with M1;

where in Formula (a2),

R1 to R3 each independently represent a hydrogen atom or an alkyl group having 1 to 3 carbon atoms; and a symbol "*1" represents a site of bonding to Z in Formula (a3); and where in Formula (a3), Z represents a substituted or unsubstituted phenylene group, provided that the substituent in the substituted phenylene group is a halogen atom or an alkyl group having 1 to 3 carbon atoms;

a symbol "*1" represents a position of bonding to the symbol "*1" in Formula (a2); and a symbol "*2" represents a position of bonding to M1 in Formula (a1).

2. The charging member according to claim 1, wherein the polymetalloxane further has a structure represented by Structural Formula (a4):

$$M1O_{(k-t)/2}(L1)_t$$ Structural Formula (a4)

where in Structural Formula (a4),

M1, k and L1 are the same as M1, k and L1 in Structural Formula (a1); and t represents an integer of 0 or more and (k−1) or less.

3. The charging member according to claim 1, wherein A1 is a bond, an alkylene group, an alkenylene group, or an atomic group having a ring selected from the group consisting of a substituted or unsubstituted benzene ring, naphthalene ring, pyrrole ring, thiophene ring, furan ring, pyridine ring, indole ring, benzothiophene ring, benzofuran ring, quinoline ring and isoquinoline ring.

4. The charging member according to claim 1, wherein Y1 is a hydroxy group, an alkoxy group, a substituted or unsubstituted aryloxy group, a carbonyl group, an alkylthio group, a substituted or unsubstituted arylthio group, a thiocarbonyl group, a substituted or unsubstituted amino group, a substituted or unsubstituted imino group, a group having a substituted or unsubstituted aliphatic heterocyclic skeleton, or a group having a substituted or unsubstituted aromatic heterocyclic skeleton.

5. The charging member according to claim 1, wherein A1 is a bond, an alkylene group, or an atomic group having a ring selected from the group consisting of a substituted or unsubstituted benzene ring, naphthalene ring, pyrrole ring, thiophene ring, furan ring, pyridine ring, indole ring, benzothiophene ring, benzofuran ring, quinoline ring and isoquinoline ring.

6. The charging member according to claim 1, wherein "s" in Structural Formula (a1) is an integer of 1 or more and (k−2) or less.

7. The charging member according to claim 1, wherein the ring formed of A1, M1, X1 and Y1 is a 5-membered ring or a 6-membered ring.

8. The charging member according to claim 1, wherein if X1 is a structure represented by Formula (1), L1 is a ligand having a structure represented by one of Formulae (5) to (9):

(5)

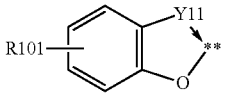

(6)

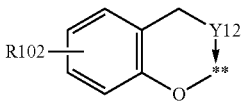

(7)

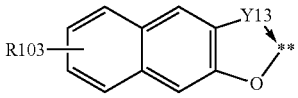

(8)

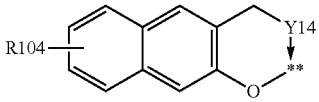

where in Formulae (5) to (8), R101 to 104 are each independently a hydrogen atom, a methoxy group or an ethoxy group; Y11 to Y14 are each independently a methoxy group, an ethoxy group, a formyl group, a methylcarbonyl group, an ethylcarbonyl group, a methoxycarbonyl group, an ethoxycarbonyl group, a dimethylamide group, a diethylamide group, a methylethylamide group, a methylthio group, an ethylthio group, a thiocarbonyl group, a dimethylamino group, a diethylamino group, an ethylmethylamino group, an unsubstituted imino group, a methanimino group, an ethanimino group, a group having a pyridine skeleton, a group having a quinoline skeleton, or a group having an isoquinoline skeleton; and a symbol "**" represents a site of bonding to M1;

(9)

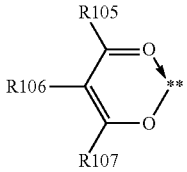

where in Formula (9), R105 is an alkyl group having 1 to 4 carbon atoms, a phenyl group, or a benzyl group; R106 is a hydrogen atom or an alkyl group having 1 to 4 carbon atoms; R107 is an alkyl group having 1 to 4 carbon atoms, an alkoxy group having 1 to 4 carbon atoms, a phenyl group, or a benzyl group; and a symbol "**" represents a site of bonding to M1.

9. The charging member according to claim 1, wherein if X1 is a structure represented by one of Formulae (2) to (4), A1 is a bond, a methylene group, an ethylene group or a trimethylene group, X1 is a structure represented by one of Formulae (2a) to (2c), (3) and (4), and Y1 is a methoxy group, an ethoxy group, a formyl group, a methylcarbonyl group, an ethylcarbonyl group, a methoxycarbonyl group, an ethoxycarbonyl group, a dimethylamide group, a diethylamide group, a methylethylamide group, a methylthio group, an ethylthio group, a thiocarbonyl group, a dimethylamino group, a diethylamino group, an ethylmethylamino group, an unsubstituted imino group, a methanimino group, an ethanimino group, a group having a pyridine skeleton, a group having a quinoline skeleton, or a group having an isoquinoline skeleton:

(2a)

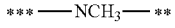

(2b)

(2c)

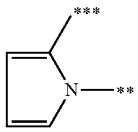

(3)

(4)

where in Formulae (2a) to (2c), (3) and (4), a symbol "" represents a site of bonding to M1; and a symbol "*" represents a site of bonding to A1.

10. The charging member according to claim 1, wherein the structural unit represented by Structural Formula (a2) is a structural unit derived from a polymer containing vinylphenol as a structural unit or a novolac-type phenolic resin.

11. A charging member comprising:

a support; and a surface layer, wherein, the surface layer comprises a reaction product of a polymer having a structural unit containing a phenolic hydroxyl group, and a metal alkoxide having a structure represented by Formula (d), and the reaction product is in an amorphous state:

$$M2(OR2)_{q-p}(L2)_p \quad (d)$$

Where in Formula (d),

M2 represents a metal atom selected from the group consisting of Ti, Zr, Hf, V, Nb, Ta, W, Al, Ga, In and Ge;

p represents an integer of 0 or more, with the proviso that (q−p) is 2 or more;

in the case that M2 is Al, Ga or In, then q=3;

in the case that M2 is Ti, Zr, Hf or Ge, then q=4;

in the case that M2 is Nb, Ta or W, then q=5;

in the case that M2 is V, then q=3 or 5;

R2 represents a hydrocarbon group having 1 to 10 carbon atoms; and

L2 represents a ligand having a structure represented by Formula (e) or a ligand having a structure represented by Formula (f):

(e)

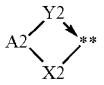

Where in Formula (e),

X2 represents a structure represented by one of Formulae (10) to (13);

Y2 represents a group having a site of coordination with M2;

A2 represents a bond or an atomic group needed to form a 4- to 8-membered ring with M2, X2 and Y2; and a symbol "**" represents a site of bonding to or coordination with M2:

(10)

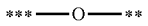

(11)

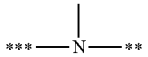

(12)

(13)

where in Formulae (10) to (13), a symbol "" represents a site of bonding to M2; and a symbol "*" represents a site of bonding to A2;

(f)

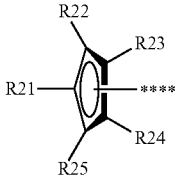

where in Formula (f), R21 to R25 each independently represent a hydrogen atom, an alkyl group having 1 to 4 carbon atoms, or a trimethylsilyl group; and a symbol "****" represents a site of coordination with M2.

12. The charging member according to claim 11, wherein A2 is a bond, an alkylene group, an alkenylene group, or an atomic group having a ring selected from the group consisting of a substituted or unsubstituted benzene ring, naphthalene ring, pyrrole ring, thiophene ring, furan ring, pyridine ring, indole ring, benzothiophene ring, benzofuran ring, quinoline ring and isoquinoline ring.

13. The charging member according to claim 11, wherein Y2 is a hydroxy group, an alkoxy group, a substituted or unsubstituted aryloxy group, a carbonyl group, an alkylthio group, a substituted or unsubstituted arylthio group, a thiocarbonyl group, a substituted or unsubstituted amino group, a substituted or unsubstituted imino group, a group having a substituted or unsubstituted aliphatic heterocyclic skeleton, or a group having a substituted or unsubstituted aromatic heterocyclic skeleton.

14. The charging member according to claim 11, wherein A2 is a bond, an alkylene group, or an atomic group having a ring selected from the group consisting of a substituted or unsubstituted benzene ring, naphthalene ring, pyrrole ring, thiophene ring, furan ring, pyridine ring, indole ring, benzothiophene ring, benzofuran ring, quinoline ring and isoquinoline ring.

15. The charging member according to claim 11, wherein "p" in Formula (d) is an integer of 1 or more.

16. The charging member according to claim 11, wherein the ring formed of A2, M2, X2 and Y2 is a 5-membered ring or a 6-membered ring.

17. The charging member according to claim 11, wherein the polymer having a structural unit containing a phenolic hydroxyl group is a polymer containing vinylphenol as a structural unit or a novolac-type phenolic resin.

18. A process cartridge detachably attachable to a main body of an electrophotographic apparatus, the process cartridge integrally supporting an electrophotographic photosensitive member and a charging member for charging the surface of the electrophotographic photosensitive member, wherein the charging member comprises a support and a surface layer, the surface layer comprises a polymetalloxane having a structure represented by Structural Formula (a1); and M1 in the polymetalloxane and a carbon atom in a structural unit represented by Structural Formula (a2) are bonded with a linking group represented by Structural Formula (a3):

Structural Formula (a1)

$$M1O_{(k-(s+1))/2}(L1)_s$$

Structural Formula (a2)

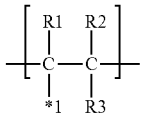

Structural Formula (a3)

*2—O—Z—*1 where in Formula (a1),

M1 represents a metal atom selected from the group consisting of Ti, Zr, Hf, V, Nb, Ta, W, Al, Ga, In and Ge;

s represents an integer of 0 or more and (k−2) or less;

in the case that M1 is Al, Ga or In, then k=3;
in the case that M1 is Ti, Zr, Hf or Ge, then k=4;
in the case that M1 is Nb, Ta or W, then k=5;
in the case that M1 is V, then k=3 or 5; and
L1 represents a ligand having a structure represented by Formula (b) or a ligand having a structure represented by Formula (c):

(b)

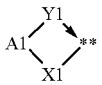

Where in Formula (b),
X1 represents a structure represented by one of Formulae (1) to (4);
Y1 represents a group having a site of coordination with M1;
A1 represents a bond or an atomic group needed to form a 4- to 8-membered ring with M1, X1 and Y1; and
a symbol "**" represents a site of bonding to or coordination with M1:

(1)

(2)

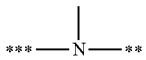

(3)

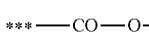

(4)

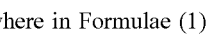

where in Formulae (1) to (4), a symbol represents a site of bonding to M1; and a symbol "***" represents a site of bonding to A1;

(c)

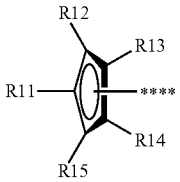

where in Formula (c), R11 to R15 each independently represent a hydrogen atom, an alkyl group having 1 to 4 carbon atoms, or a trimethylsilyl group; and a symbol "****" represents a site of coordination with M1;
where in Formula (a2), R1 to R3 each independently represent a hydrogen atom or an alkyl group having 1 to 3 carbon atoms; and a symbol "*1" represents a site of bonding to Z in Formula (a3); and
where in Formula (a3),
Z represents a substituted or unsubstituted phenylene group, provided that the substituent in the substituted phenylene group is a halogen atom or an alkyl group having 1 to 3 carbon atoms;
a symbol "*1" represents a position of bonding to the symbol "*1" in Formula (a2); and
a symbol "*2" represents a position of bonding to M1 in Formula (a1).

19. An electrophotographic apparatus comprising an electrophotographic photosensitive member and a charging member for charging the surface of the electrophotographic photosensitive member, wherein the charging member comprises
a support and a surface layer,
the surface layer comprises
a polymetalloxane having a structure represented by Structural Formula (a1); and
M1 in the polymetalloxane and a carbon atom in a structural unit represented by Structural Formula (a2) are bonded with a linking group represented by Structural Formula (a3):

Structural Formula (a1)

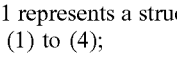

Structural Formula (a2)

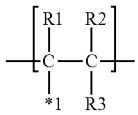

Structural Formula (a3)

where in Formula (a1),
M1 represents a metal atom selected from the group consisting of Ti, Zr, Hf, V, Nb, Ta, W, Al, Ga, In and Ge; s represents an integer of 0 or more and (k−2) or less;
in the case that M1 is Al, Ga or In, then k=3;
in the case that M1 is Ti, Zr, Hf or Ge, then k=4;
in the case that M1 is Nb, Ta or W, then k=5;
in the case that M1 is V, then k=3 or 5; and
L1 represents a ligand having a structure represented by Formula (b) or a ligand having a structure represented by Formula (c):

(b)

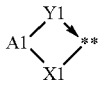

where in Formula (b),
X1 represents a structure represented by one of Formulae (1) to (4);
Y1 represents a group having a site of coordination with M1;
A1 represents a bond or an atomic group needed to form a 4- to 8-membered ring with M1, X1 and Y1; and
a symbol "**" represents a site of bonding to or coordination with M1:

(1)

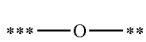

(2)

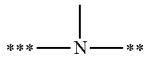

(3)

(4)

where in Formulae (1) to (4), a symbol "" represents a site of bonding to M1; and a symbol "*" represents a site of bonding to A1;

(c)

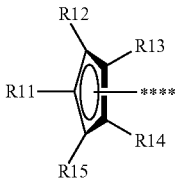

where in Formula (c), R11 to R15 each independently represent a hydrogen atom, an alkyl group having 1 to 4 carbon atoms, or a trimethylsilyl group; and a symbol "****" represents a site of coordination with M1;

where in Formula (a2), R1 to R3 each independently represent a hydrogen atom or an alkyl group having 1 to 3 carbon atoms; and a symbol "*1" represents a site of bonding to Z in Formula (a3); and where in Formula (a3), Z represents a substituted or unsubstituted phenylene group, provided that the substituent in the substituted phenylene group is a halogen atom or an alkyl group having 1 to 3 carbon atoms;

a symbol "*1" represents a position of bonding to the symbol "*1" in Formula (a2); and a symbol "*2" represents a position of bonding to M1 in Formula (a1).

* * * * *